US008000638B2

(12) United States Patent
Ohmura et al.

(10) Patent No.: US 8,000,638 B2
(45) Date of Patent: Aug. 16, 2011

(54) DEVELOPING DEVICE USING TWO-COMPONENT DEVELOPING AGENT AND IMAGE FORMING APPARATUS PROVIDED WITH SAME

(75) Inventors: Tomoya Ohmura, Kanagawa (JP); Junichi Matsumoto, Kanagawa (JP); Natsumi Katoh, Kanagawa (JP); Nobuo Iwata, Kanagawam (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/489,003

(22) Filed: Jun. 22, 2009

(65) Prior Publication Data

US 2009/0317106 A1 Dec. 24, 2009

(30) Foreign Application Priority Data

Jun. 24, 2008 (JP) ..... 2008-164165
Aug. 5, 2008 (JP) ..... 2008-202465
Feb. 12, 2009 (JP) ..... 2009-029384

(51) Int. Cl.
*G03G 15/08* (2006.01)

(52) U.S. Cl. ..... 399/259; 399/53; 399/254

(58) Field of Classification Search ..... 399/53, 399/252, 254–256, 258, 259, 292
See application file for complete search history.

(56) References Cited

U.S. PATENT DOCUMENTS 5,727,607 A * 3/1998 Ichikawa et al. ..... 141/67
2003/0156859 A1 8/2003 Tamai
2004/0184840 A1* 9/2004 Hays ..... 399/252
2007/0154242 A1 7/2007 Matsumoto et al.
2007/0264053 A1 11/2007 Iwata et al.
2008/0298844 A1 12/2008 Katoh et al.
2008/0298845 A1 12/2008 Ohmura et al.
2008/0298866 A1 12/2008 Matsumoto et al.
2009/0028611 A1 1/2009 Matsumoto et al.
2009/0123174 A1 5/2009 Iwata et al.

FOREIGN PATENT DOCUMENTS

JP 7-134481 5/1995
JP 8-198202 8/1996
JP 10-63081 3/1998
JP 10-240007 9/1998
JP 2004-85879 3/2004
JP 2004-240460 8/2004
JP 2007-193301 8/2007
JP 2008-3560 1/2008
JP 2008-299107 12/2008

* cited by examiner

*Primary Examiner* — David P Porta
*Assistant Examiner* — Benjamin Schmitt
(74) *Attorney, Agent, or Firm* — Oblon, Spivak, McClelland, Maier & Neustadt, L.L.P.

(57) ABSTRACT

A developing device that efficiently adjusts the amount of charge on the developing agent without being affected by external conditions, and that continuously supplies a developing agent with the appropriate toner concentration and amount of charge. An ionized air flow adjusts the amount of charge on the developing agent discharged from the developing unit to improve the dispersability of the replenished toner without applying unnecessary stress. The developing agent is raised upwards by a screw, downwards by an agitation member, and then gathered by a screw in a circulating flow. Consequently, the developing agent is uniformly mixed within the developing agent agitation unit. This circulating flow of the developing agent increases the probability of contact and reduces damage to the developing agent. When the ionized air flow reduces the amount of charge before agitation, the toner can be uniformly charged to the appropriate value.

18 Claims, 29 Drawing Sheets

DEVELOPING DEVICE USING TWO-COMPONENT DEVELOPING AGENT AND IMAGE FORMING APPARATUS PROVIDED WITH SAME

BACKGROUND OF THE INVENTION

1. Field of the Invention

The present invention relates to a developing device that uses two-component developing agent, and an image forming apparatus provided with the developing device, and more particularly relates to the agitation mechanism of the two-component developing agent.

2. Description of the Related Art

In image forming apparatus such as photocopiers, printers, facsimile machines, printing machines, and soon, the recorded output is obtained by processing an electrostatic latent image formed on a photosensitive member or latent image carrier using a developing device to obtain a visible image, then the visible image is transferred onto a sheet or the like.

The developing agent used in developing may be a one part developing agent containing magnetic or non-magnetic toner only, or it may be a two-component developing agent that is a mixture of toner and a carrier. Two-component developing agent includes toner and carrier to carry the toner. When the two-component toner is agitated and mixed, the toner becomes charged by the frictional electrostatic effect, so that the toner can be electrostatically attracted to the electrostatic latent image on the photosensitive body.

A developing device frequently includes a developing sleeve that draws up the developing agent onto its peripheral surface by magnetic force and supplies the developing agent to the electrostatic latent image on the photosensitive body, and an agitating sleeve that supplies agitated and mixed developing agent to the developing sleeve. The developing agent from which the toner was consumed in visible image processing of the electrostatic latent image on the photosensitive body is recovered in the developing device, mixed with replenished toner, agitated, and again used for developing. Therefore, the developing agent used in a developing device constituted in this way must maintain a constant toner temperature and electrostatic charge, in order to obtain stable toner images. The toner temperature is adjusted depending on the quantity of toner consumed in developing and the quantity of replenished toner, and the amount of electrostatic charge applied by the frictional electrostatic charge when mixing the carrier and toner. Therefore in this type of developing device, the two-component developing agent formed from the toner and carrier is sufficiently agitated, so that the toner temperature distribution becomes uniform, the toner becomes charged, and the toner images are made stable.

However, the amount of charge varies depending on various factors, so even under uniform agitation conditions the amount of charge will vary. For example, these factors can include the surrounding environment (temperature and humidity), the reduction in the carrier charging performance with time, the variation in amount of charge on the toner with the area of image output, in other words, there is a variation in the amount of charge depending on the holding time of the toner. Also, variation in the amount of charge is caused by the amount of newly replenished toner. This is because the greater the quantity of toner, the greater the time required for mixing and agitation.

Conventionally, normally in this type of developing device, in the short period of time until the replenished toner is scooped up and supplied to the developing sleeve, the toner must be dispersed and charged using an agitation screw. However, if toner consumption (consumption and supply) is high, the replenished toner can be scooped up by the developing sleeve without being sufficiently dispersed, and as a result, contamination of the surface of the photosensitive member due to insufficient charging or contamination of the surrounding parts due to dispersion of toner in the air can occur.

In order to prevent dispersion of toner in the air and image defects caused by this type of insufficient mixing and agitation, in other words insufficient toner charging, providing a plurality of mixing and agitation members within the developing device to improve the mixing and agitation has been proposed. However, although the initial problem is solved in this way, the agitation stress on the developing agent is increased, which causes a reduction in the charging capacity due to degradation of the developing agent with time. As a result, the amount of charging is unstable, so the problems of dispersion of the toner in the air and contamination of surfaces with time remain. When stress is applied to the developing agent, the charging capacity is reduced by the removal of the coating film, the charging capacity is reduced by the embedment of additives in the toner, and the fluidity is changed, and so on. The changes in fluidity is also a cause of reduction in image quality due to changes in charging capacity and changes in the transfer ratio.

In order to solve these problems, a constitution has been proposed in which the agitation unit is provided in a location separate from the developing unit, and the developing unit and the agitation unit are connected by circulation means. Then, after the toner concentration and amount of charging of the developing agent within the agitation unit is made optimum for the developing unit, the developing agent is transported to the developing unit has been proposed. See, for example, Japanese Patent Application Laid-open No. 2008-003560 (hereafter referred to as Prior Art 1), Japanese Patent Application Laid-open No. 2007-193301 (hereafter referred to as Prior Art 2), Japanese Patent No. 3349286 (hereafter referred to as Prior Art 3), Japanese Patent Application Laid-open No. H11-143196 (hereafter referred to as Prior Art 4), and so on.

In Prior Art 1, agitation is carried out by rotating a shaft on which a plurality of agitation members has been provided. This type of agitation method is widely used.

In Prior Art 2, a constitution is disclosed in which the developing agent is circulated between the developing device and an agitation device, and the agitation device is provided with an agitation member such as a paddle or a screw or the like. Developing agent that has been agitated and mixed within the agitation device is transported to the developing device. Then agitation and mixing of the developing agent contained within the developing device is carried out by a plurality of agitation and transport screws provided in the developing device.

In Prior Art 3 a constitution is disclosed in which a screw whose axis is vertical is disposed within the agitation device as described above, and developing agent that is dropping down is made to contact developing agent that is raised by the rotation direction of the screw, and charging and agitation is caused by the friction.

In Prior Art 4, a constitution is disclosed in which an agitation member and a transport screw having their shafts in the horizontal direction are provided. Toner that drops from a toner replenishment tank is frictionally charged by the agitation, then the developing agent is transported to the developing unit via a transport screw using a Mohno pump.

However, in the toner agitation unit, it is necessary to appropriately charge the toner for replenishing the developing agent whose toner concentration has been reduced after developing, and transport it to the developing device so that the developing agent will have the appropriate toner concentration. However, the developing agent is continuously circulated on a path, and the toner content changes after developing, so it is difficult to always maintain a constant amount of charge and toner concentration without changing the circulation amount (flow rate).

Each of the above prior art documents will now be examined from the above point of view. In the constitution according to Prior Arts 2 and 4, the agitation operation can be easily made uniform, but a long amount of time is required to agitate all the contents of the agitation unit within which the agitation screw is housed. Therefore, to reduce the time it is necessary to make the agitation unit larger, which increases the quantity of developing agent held, which is then held longer in the agitation unit. Moreover, increasing the agitation speed of the agitation member in order to reduce the time causes new problems such as increasing the stress on the developing agent, and increasing the load on the drive system due to the reaction load from the developing agent.

Also, in the constitution disclosed in Prior Art 3, an agitation screw that raises the downward falling developing agent upward is used. However, frictional charging occurs when there is contact between the downward falling developing agent within the range of the developing agent being raised by the agitation screw. Therefore, the charging function is limited to the size of the area occupied by the agitation screw, and it is difficult to expect uniform charging capability of the developing agent in all the areas containing developing agent. In particular, the developing agent that is falling downwards relative to the developing agent that is being raised by the blades of the screw extends throughout all the developing agent areas of the agitation unit. Therefore, to apply sufficient amount of charge to the toner it is necessary to increase the length of the screw in its axial direction. Also, instead of this constitution which results in a larger size, if the rotation speed of the screw is increased, the new problem of damage to the toner will be caused, as discussed for the constitutions disclosed in Prior Arts 2 and 3.

On the other hand, it is possible to consider widening the agitation area by providing another agitation blade on the outer periphery of a paddle or screw having its axis in the vertical direction as disclosed in Prior Art 2. However, in this constitution, there is the problem of discharge of insufficiently charged developing agent in the gap between the members used for agitation or the gap between the agitation blade positioned on the outer periphery and the internal surface of the agitation unit. Therefore increasing the rotation speed of the members used for agitation can be considered, but in this constitution the new problem of acceleration of degradation of the developing agent is caused.

Technologies relating to the present invention are also disclosed in, e.g., Japanese Patent Application Laid-open No. H07-134481, Japanese Patent Application Laid-open No. H10-063081, Japanese Patent Application Laid-open No. H10-240007, and Japanese Patent Application Laid-open No. 2004-085879.

SUMMARY OF THE INVENTION

It is an object of the present invention to provide a developing device and an image forming apparatus containing this developing device that is capable of obtaining an appropriate image density by continuously supplying just the necessary amount of developing agent containing toner having the appropriate concentration and amount of charge to the developing device.

It is another object of the present invention to provide a developing device and an image forming apparatus containing this developing device that is capable of efficiently applying the appropriate amount of charge in a short period of time to the toner for replenishing the developing agent that contains a reduced concentration of toner after being used for developing.

It is another object of the present invention to provide a developing device and an image forming apparatus containing this developing device that is capable of efficiently adjusting the amount of charging of the developing agent without being affected by external disturbing conditions (conditions of use, and the like), by mixing and agitating without applying unnecessary stress to the developing agent.

In an aspect of the present invention, a developing device uses a two-component developing agent comprising toner and carrier. The developing device comprises a developing unit; a developing agent agitation unit provided separate from the developing unit; an ionized air flow generation device for generating an ionized air flow; a developing agent circulation path for circulating the developing agent between the developing unit and the developing agent agitation unit; and an ionized air flow inlet provided on the developing agent circulation path, for introducing the ionized air flow generated by the ionized air flow generation device, in order to adjust the amount of charge of the toner and carrier in the developing agent.

In another aspect of the present invention, a developing device comprises a developing roller that carries and transports a developing agent; a first transport screw that supplies the developing agent to the developing roller while transporting the developing agent in the longitudinal direction; a second transport screw that transports the developing agent in the opposite direction to the direction of transport of the developing agent by the first transport screw; a toner replenishment aperture that is provided on the upstream side of the direction of transport of the developing agent by the second transport screw and that is used for replenishing toner; and an ionized air flow inlet that is provided below the second transport screw and on the downstream side in the direction of transport of the developing agent from the toner replenishment aperture, and that is used for introducing an ionized air flow.

In another aspect of the present invention, an image forming apparatus comprises a developing device using a two-component developing agent comprising toner and carrier. The developing device comprises a developing unit; a developing agent agitation unit provided separate from the developing unit; an ionized air flow generation device for generating an ionized air flow; a developing agent circulation path for circulating the developing agent between the developing unit and the developing agent agitation unit; and an ionized air flow inlet provided on the developing agent circulation path, for introducing the ionized air flow generated by the ionized air flow generation device, in order to adjust the amount of charge of the toner and carrier in the developing agent.

In another aspect of the present invention, a method of developing a latent image with a two-component developing agent comprising toner and carrier uses a developing device. The developing device comprises a developing unit; a developing agent agitation unit provided separate from the developing unit; a developing agent circulation path for circulating the developing agent between the developing unit and the developing agent agitation unit; and an ionized air flow generation device for generating an ionized air flow. An ionized air flow inlet is provided on the developing agent circulation path, for introducing the ionized air flow generated by the ionized air flow generation device, in order to adjust the amount of charge of the toner and carrier in the developing agent.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENT(s)

Figure 1:
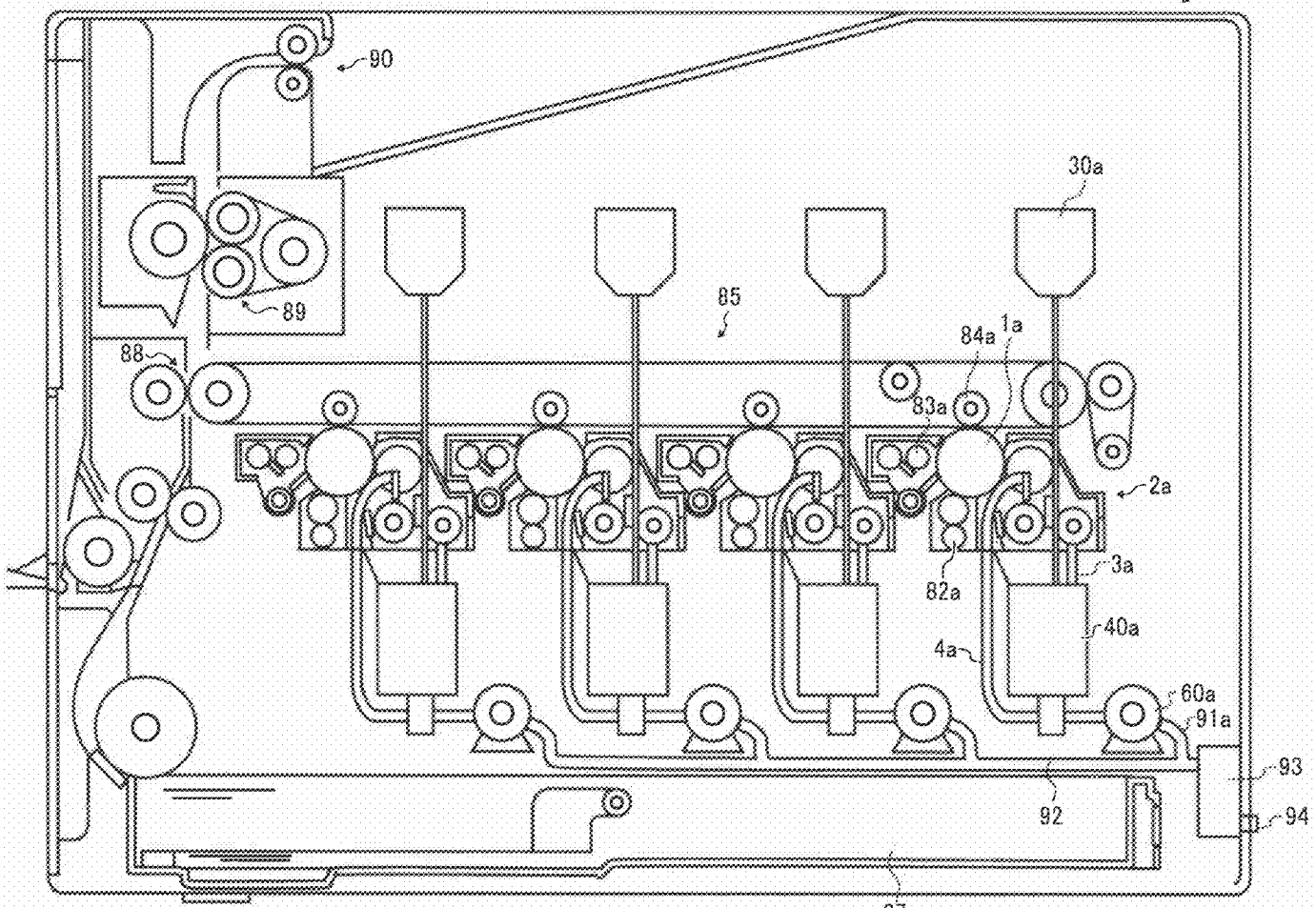
FIG. 1 is a diagram showing the overall constitution of an image forming apparatus according to Embodiment 1 of the present invention.

Preferred embodiments of the present invention will be described hereinafter. It is to be noted that the reference numerals used in each embodiment are independent of the reference numerals of the other embodiments, i.e., the same reference numerals do not always designate the same structural elements.

Embodiment 1

The present embodiment is a developing device that uses two-component developing agent that includes toner and carrier. A developing agent agitation unit is provided separate from a developing unit, and ionized air flow generation means is provided, and the developing agent is circulated between the developing unit and the developing agent agitation unit. An ionized air flow inlet for adjusting the amount of charge on the toner and carrier is provided on the path for circulating the developing agent. Also the ionized air flow inlet is provided in the discharge path from the developing unit to the developing agent agitation unit, on the supply path from the developing agent agitation unit to the developing unit, or in the developing agent agitation unit. The operation of the ionized air flow generation means can be arbitrarily turned on or off, and the ion balance of the positive ions and the negative ions can be arbitrarily controlled. A mesh or porous plate through which the carrier cannot pass or means having the same function as these is disposed on the ionized air flow inlet, and the ionized air flow is introduced from a direction in opposition to the direction of circulation of the developing agent.

FIG. 1 shows the overall constitution of an example of image forming apparatus according to the present embodiment. This apparatus is a color image forming apparatus, in the FIG. 81 is the main body of the apparatus, and image forming units corresponding to the four colors yellow, magenta, cyan, and black are disposed below an intermediate transfer belt 85. The constitution of the image forming unit for each color is the same, and includes a photosensitive member 1, a charging unit 82, a developing unit 2, a primary transfer unit 84, a cleaning unit 83, and so on.

In operation, first the photosensitive member 1 is uniformly charged by the charging unit 82. Next, an electrostatic latent image corresponding to the image to be formed is formed on the surface of the photosensitive member 1 by an optical reading unit that is not shown on the drawings. Then the latent image is developed by the developing unit 2, to form a toner image on the photosensitive member 1. The toner images in each color formed by each image forming unit in this way are successively transferred onto the intermediate transfer belt 85 by the primary transfer unit 84. In this way a full color toner image is formed on the intermediate transfer belt 85. This full color toner image is transferred onto a transfer sheet supplied from a sheet supply cassette 87 by a secondary transfer unit 88. Next, the transfer sheet is passed through a fixing unit 89, the toner is melted by heat, and the color toner image is fixed to the transfer sheet. Reference numeral 90 is a sheet discharge unit for discharging the formed images. In the figure, 91 is an air suction inlet, 92 is an external air suction path, 93 is a dehumidification device, and 94 is an air inlet.

In the constitution of the present embodiment, the developing unit 2 has special characteristics. Normally the developing agent (toner and carrier) used in developing is agitated and mixed only in the developing unit. However, in the constitution of the present embodiment, a developing agent agitation unit 40 is provided in a location separate from the developing unit 2. The developing agent is thoroughly agitated in the developing agent agitation unit 40, so the toner is more stably charged than conventionally, and in this way it is possible to carry out stable image forming.

The following is an explanation of its operation.

After carrying out developing in the developing unit 2, the developing agent is discharged from the developing unit 2 via a developing agent discharge flow path 3 and fed into the developing agent agitation unit 40. Next, the developing agent agitation unit 40 is replenished with new toner, sufficient agitation is carried out by an agitation fin, which is not shown on the drawings, and then a fixed quantity at a time is discharged by a rotary feeder, which is not shown on the drawings. The discharged developing agent is transported by the pressure of air from an air pump 60, and returned to the developing unit 2 via a developing agent supply flow path 4. Replenishment with new toner is carried out by discharging the toner a little at a time from a toner hopper 30.

Figure 2B:
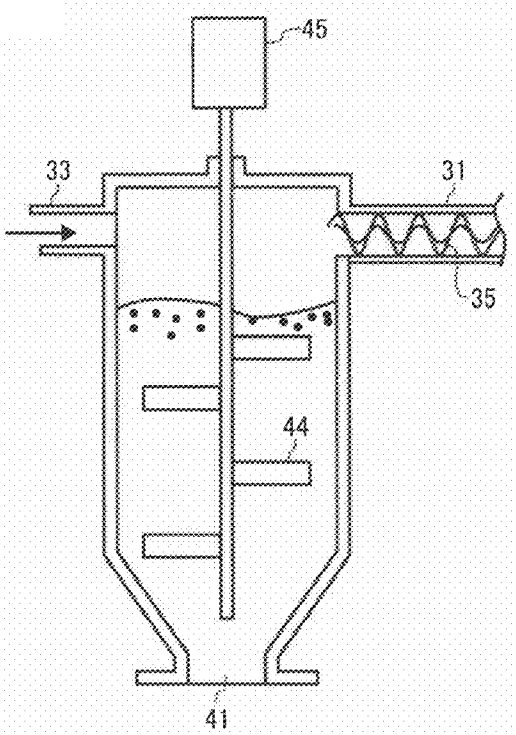
FIGS. 2A and 2B are perspective diagrams showing the detailed constitution of the developing unit, the developing agent agitation unit, the rotary feeder unit, and the air pump of this image forming apparatus.
Figure 2A:
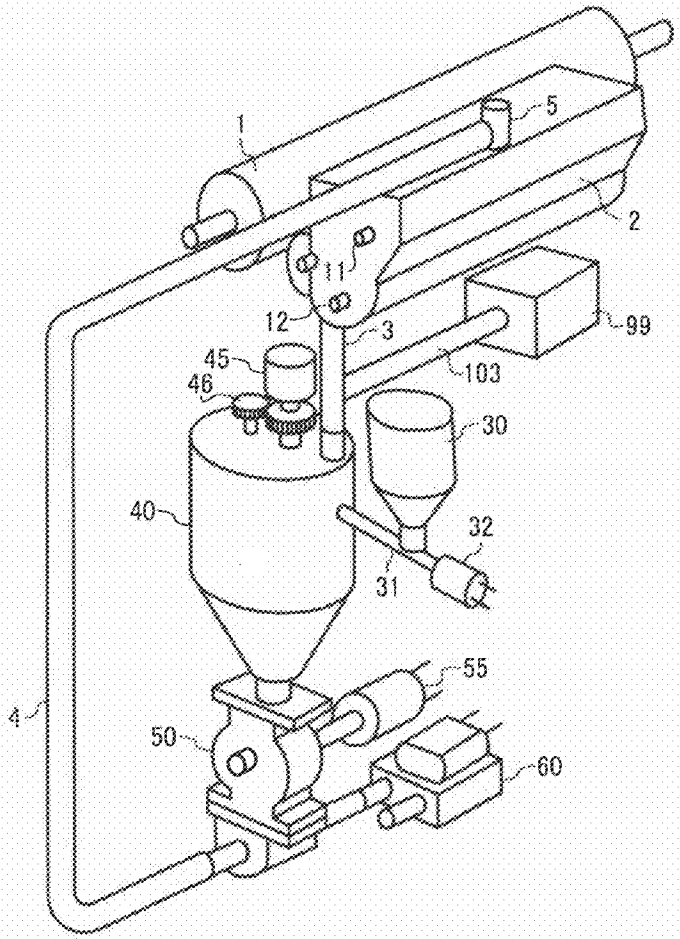
Figure 3:
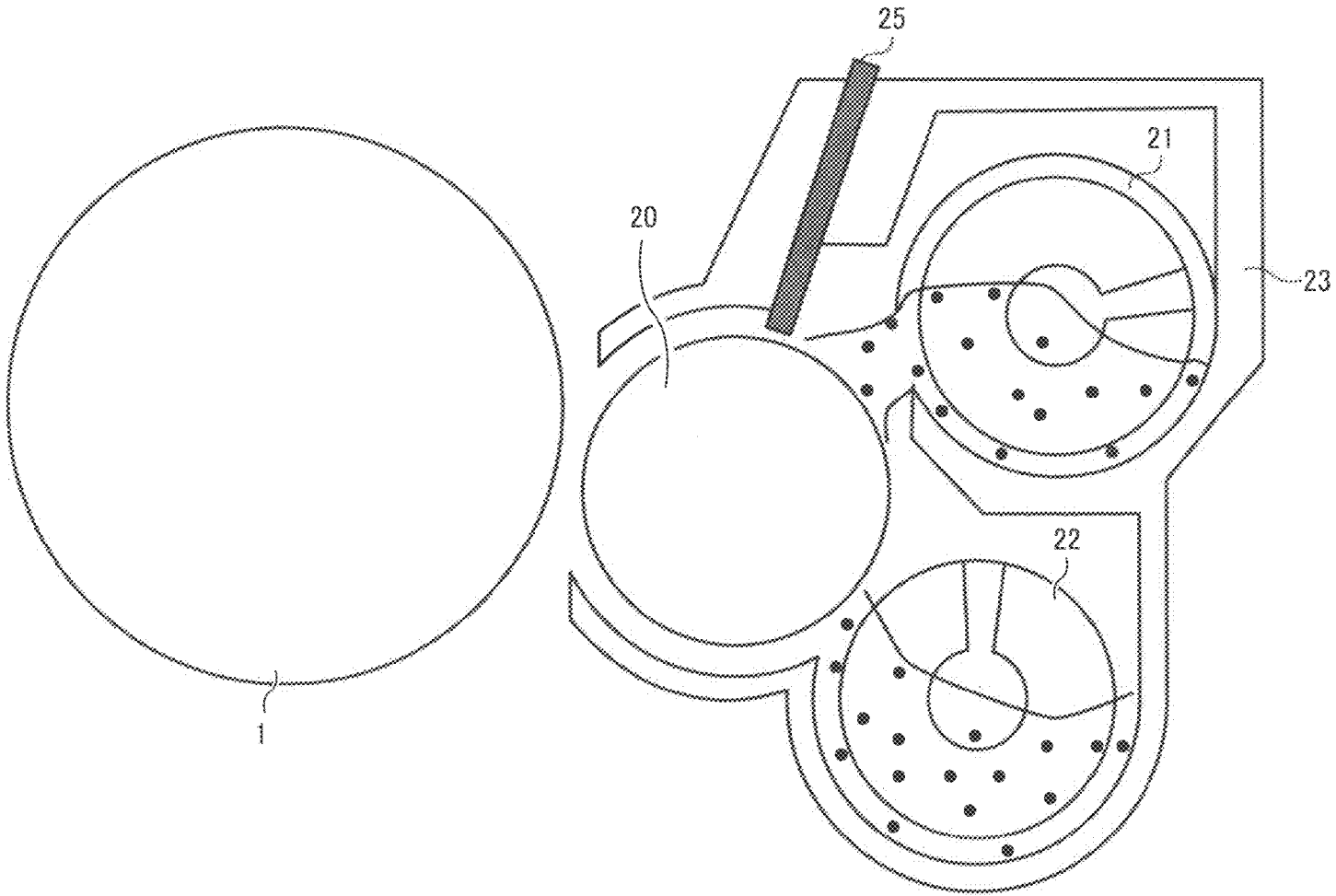
FIG. 3 is a diagram showing the internal constitution of the developing unit.

FIGS. 2A and 2B show the constitution of the developing unit 2, the developing agent agitation unit 40, the rotary feeder unit, and the air pump of the present embodiment. In the figure, 1 is a photosensitive drum on the surface of which electrostatic latent images are formed by a charging device and an optical reading device, which are not shown on the drawings. Reference numeral 2 is the developing unit (whose internal constitution is shown in FIG. 3). Also, 40 indicates the whole developing agent agitation unit. Developing agent discharged from a developing agent discharge unit of the developing unit 2 falls under its own self-weight within the developing agent discharge flow path 3, and is fed into the developing agent agitation unit 40.

In the developing agent agitation unit 40, a shaft on which an agitation member 44 is provided is rotationally driven by an agitation motor 45 via a gear 46. Also, as toner is consumed the developing agent agitation unit 40 is replenished with new toner from the toner hopper 30. Toner is replenished via a toner supply path 31 using a drive motor 32. As shown in FIG. 2B, a small transport screw (auger) 35 is disposed within the toner supply path 31, constituted so that a fixed quantity of toner can be transported. In the figure, 41 is a toner outlet aperture to the rotary feeder 50, which is described later.

The rotary feeder 50 operates by rotating an internal impeller to discharge a fixed quantity of agitated developing agent every time. In the figure, 55 is a rotary feeder operation motor.

The fixed quantity of developing agent discharged by the rotary feeder 50 is transported by the pressure of air supplied by the air pump 60 through the developing agent supply flow path 4, and returned to a developing agent input unit 5 in the developing unit 2. In the figure, 99 is an ionizer, and 103 is an ionized air flow inlet.

FIG. 3 is a diagram showing the constitution of the interior of the developing unit 2. In the figure, 20 is a developing roller, within which a magnet is disposed, which acts to attract and transport developing agent and cause the developing agent to adhere to the electrostatic latent image on the surface of the photosensitive member 1. In the figure, 21 and 22 are transport screws. The transport screw 21 is driven so that developing agent supplied to the developing agent input unit 5 provided in the central position in the length direction (normal to the plane of the paper in the figure) is divided and transported towards the near side and the far side relative to the plane of the paper in the figure. The transport screw 22 is rotationally driven so that developing agent is transported to the near side in the figure. Also, on the near side of the transport screw 22, a developing agent discharge unit is provided to discharge the developing agent to the outside. In the figure, 25 is a doctor plate for leveling the developing agent adhering to a developing sleeve to a uniform amount, and 23 is a casing that covers the developing unit 2.

Next, the ionized air flow and agitation unit, which are characteristics of the present embodiment, are explained.

Figure 4A:
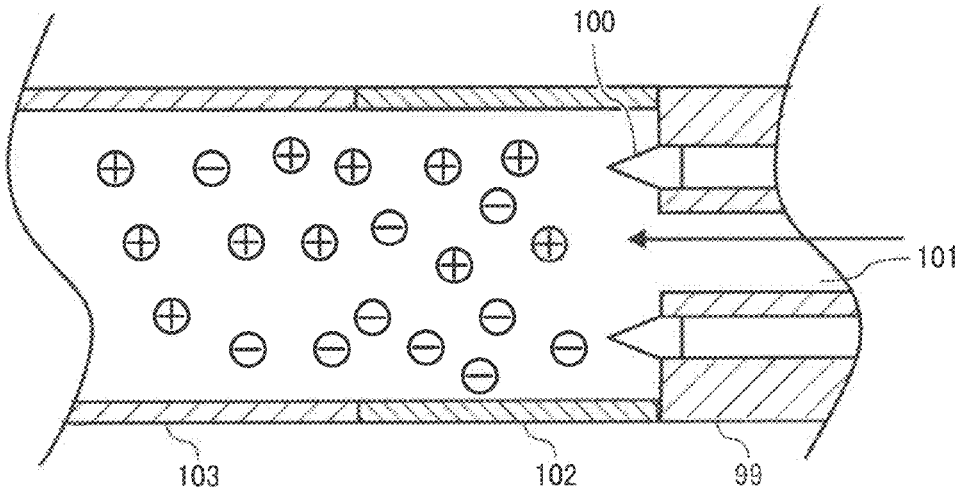
FIGS. 4A and 4B are diagrams showing the constitution of the ionizer that is means for generating an ionized air flow.
Figure 4B:
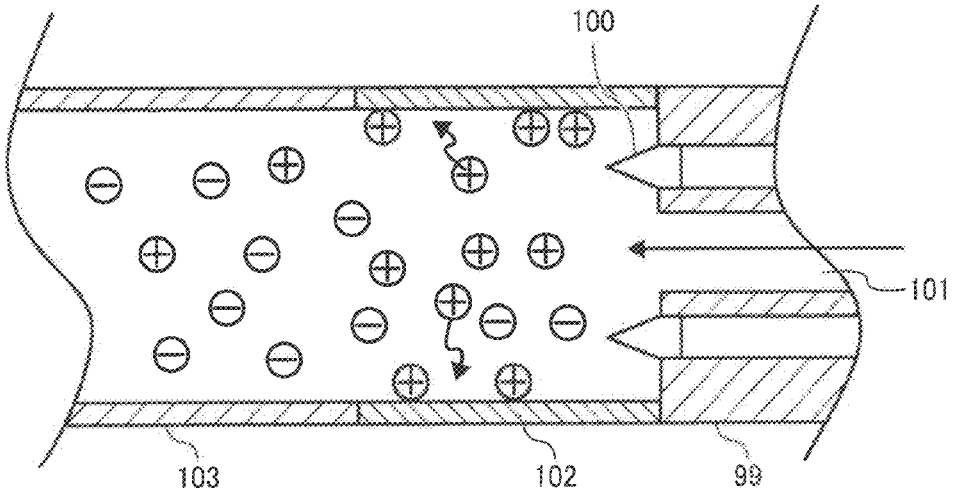

FIGS. 4A and 4B are constitution diagrams of the ionizer 99, which is means for generating an ionized air flow. A pair of electrode needles 100 is provided within the ionizer 99, and by applying a high voltage positive and negative pulse to the electrode needles 100, corona discharge is caused, positive and negative ions are generated from the two electrode needles. The generated positive and negative ions are fed by a propeller or air pump or the like through an air flow aperture 101, into the air flow, so it becomes an ionized air flow and is transported to an ionized air flow inlet. Also, an electrode 102 is provided within the flow path of the ionized air flow as shown in FIG. 4, in order to change the positive and negative ion balance. By setting the voltage at the electrode 102, and by attracting the ions of the opposite polarity (in FIG. 4B a negative voltage is applied so positive ions are attracted to the electrode), it is possible to generate ions with the ion balance biased in one direction. In addition, by applying a direct current voltage to the electrode needles in the ionizer 99, it is possible to generate either positive or negative ions. Or, by generating ions using soft X-rays or vacuum ultraviolet light, the generation of ozone can be reduced. In the present invention the ionizer 99 can be used as appropriate in accordance with the application.

Figure 5:
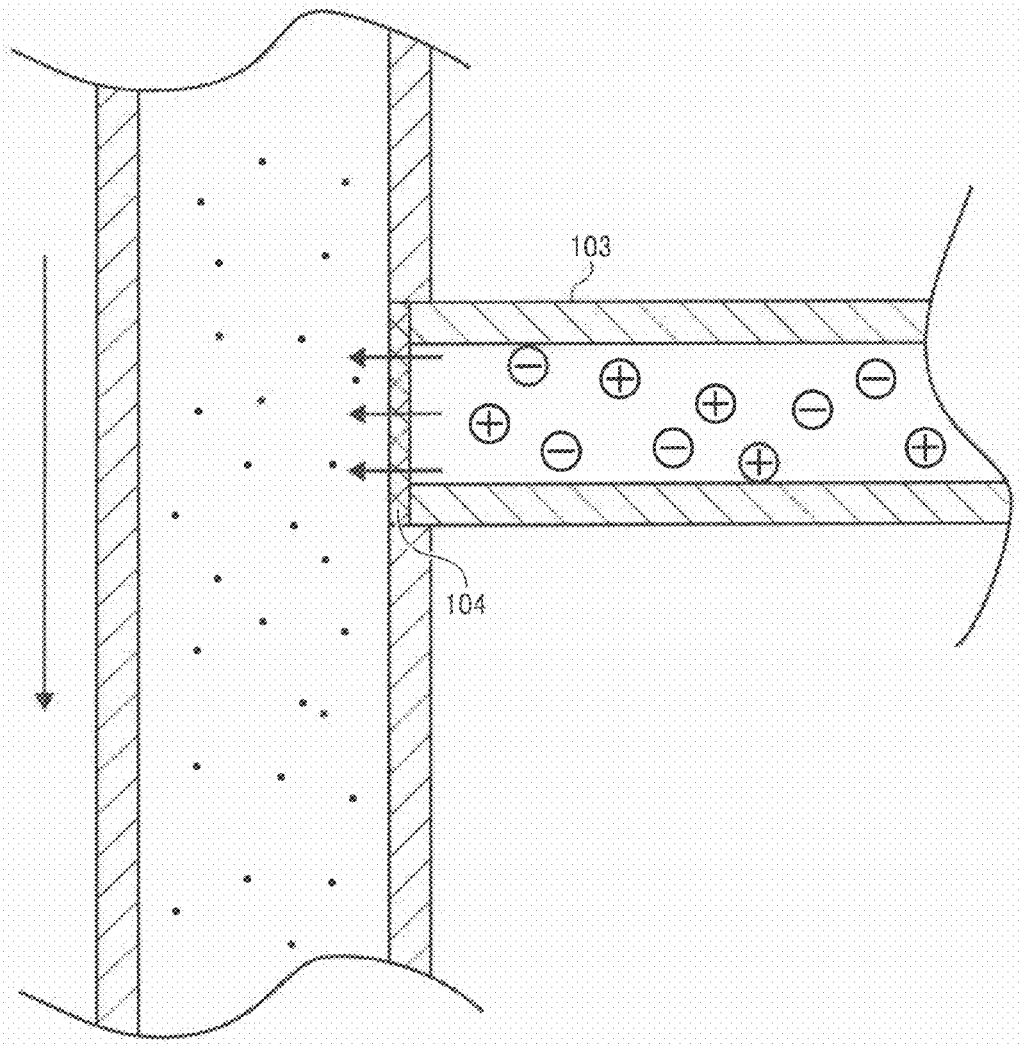
FIG. 5 is a cross-section diagram showing the ionized air flow inlet provided in the developing agent discharge flow path from the developing unit to the developing agent agitation unit, and the state in which the ionized air flow from the ionizer is fed to the developing agent discharge flow path via a flow path.

FIG. 5 is a cross-section diagram showing the ionized air flow inlet provided in the developing agent discharge flow path from the developing unit to the developing agent agitation unit, and the state in which the ionized air flow from the ionizer is fed to the developing agent discharge flow path via a flow path. In the examples shown in FIGS. 2A and 2B and FIG. 5, the ionized air flow inlet 103 is provided in the developing agent discharge flow path 3 from the developing unit 2 to the developing agent agitation unit 40, via a mesh or porous plate 104 through which carrier cannot pass. The ionized air flow from the ionizer 99 is fed to the developing agent discharge flow path 3 via the ionized air flow inlet 103 and the mesh or porous plate 104. As shown in FIG. 5, the ionized air flow is blown against the developing agent passing through the developing agent discharge flow path 3, and the amount of charge on the developing agent is changed (lowered) by the absorption of ions by the toner or the carrier within the developing agent.

Figure 6A:
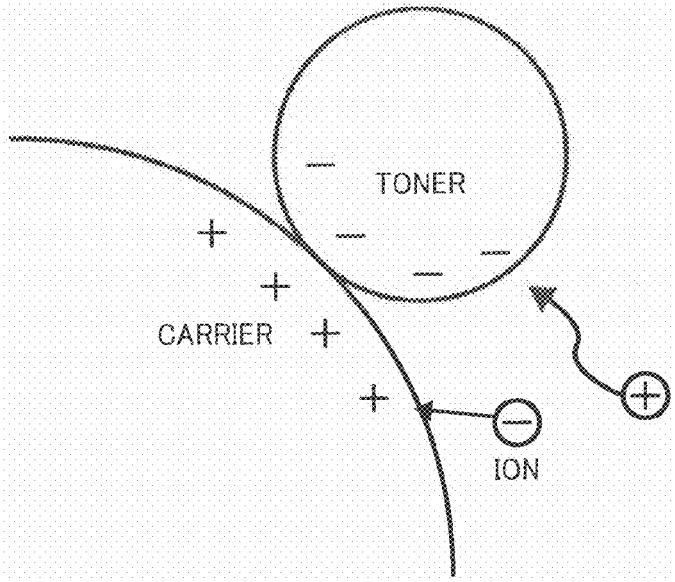
FIGS. 6A and 6B are schematic diagrams showing the mechanisms of FIG. 5.
Figure 6B:
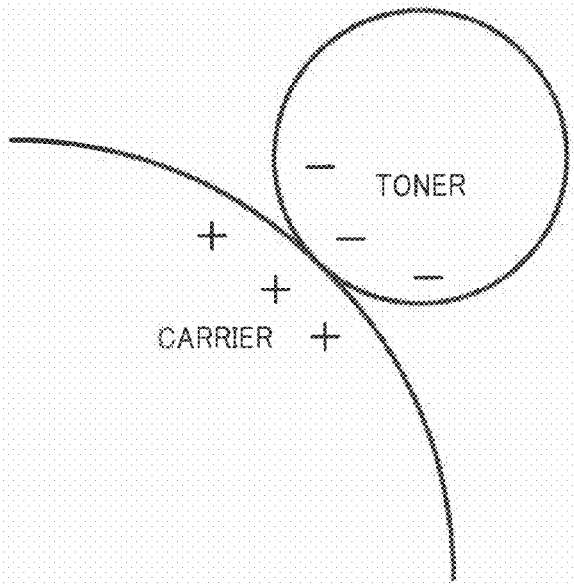

FIGS. 6A and 6B are schematic diagrams of the above mechanism, for example the positive ions are attracted to the negatively charged toner, so the charge on the toner is reduced, and the negative ions are attracted to the positively charged carrier so the charge is reduced. By continuously blowing the ionized air flow against the developing agent discharged from the developing unit, the amount of charge on the developing agent is uniformly reduced.

Normally, the amount of charge on the toner varies due to various factors, so even under the same agitation conditions the amount of charge will vary. For example, these factors include the surrounding environment (temperature and humidity), the reduction of the charging capacity of the carrier with time, the variation in the toner charge amount due to the area of the image output, in other words, the amount of charge varies depending on the toner holding time. Further, the differences in amount of charge cause differences in the electrostatic adhesion force, and these differences are significant between the toner that has been retained within the developing unit and newly supplied toner. However, by reducing the difference in amount of charge between these toners before agitation, in the present invention the difference in electrostatic adhesion force is eliminated. Therefore it is possible to uniformly disperse the newly supplied toner and the toner that has been retained within the developing device within the developing agent, and it is possible to stabilize the amount of charge on the toner itself.

Figure 7:
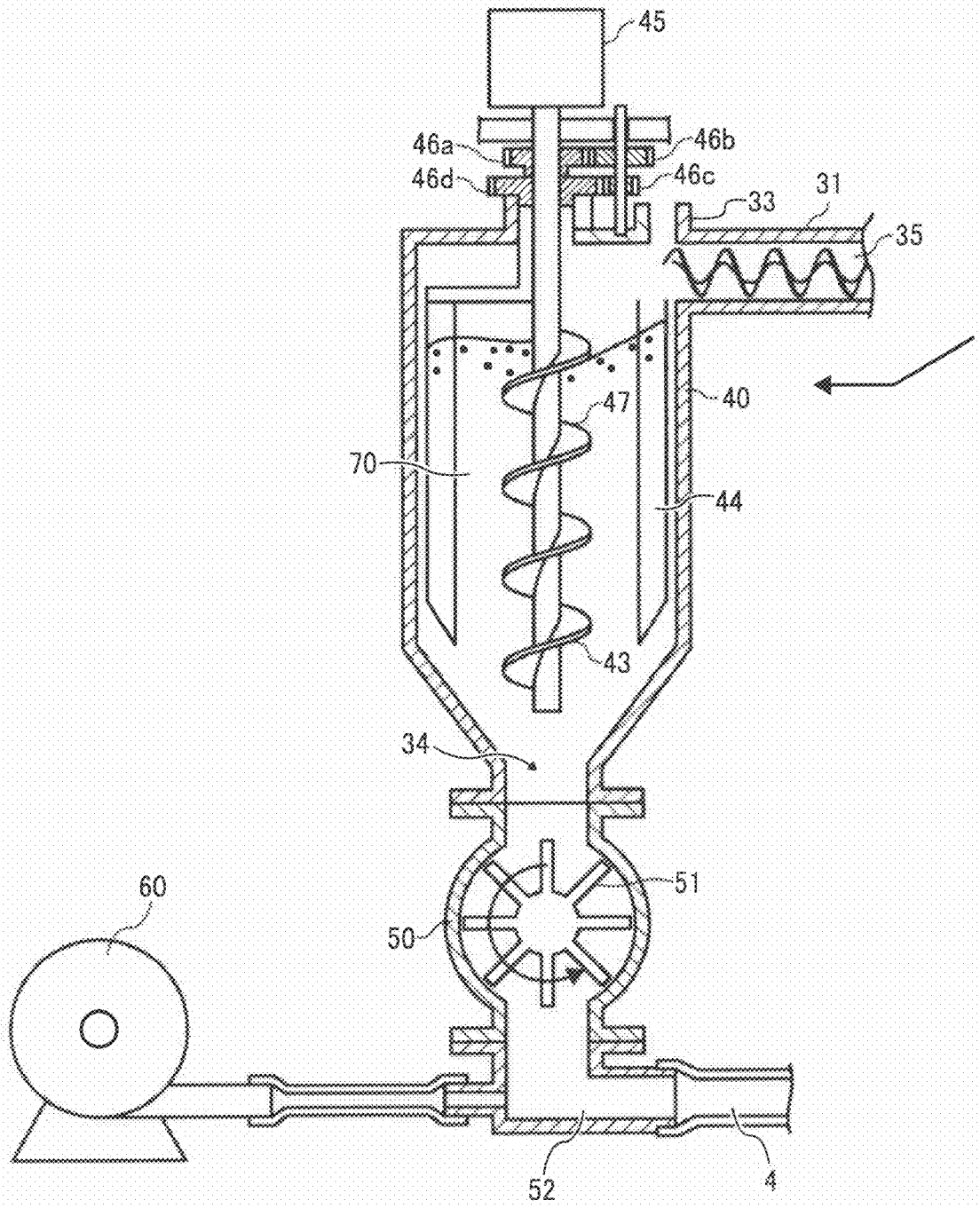
FIG. 7 is a diagram showing the cross-section and detailed constitution of the developing agent agitation unit and the rotary feeder unit.

FIG. 7 is a diagram showing the cross-section and details of the developing agent agitation unit 40 and the rotary feeder 50 according to another example. The developing agent agitation unit 40 has the role of agitating the developing agent, charging the toner, and continuously and stably supplying developing agent having the appropriate toner concentration and amount of charge. For this purpose it is necessary to agitate the developing agent efficiently in a short period of time, and it is desirable that the stress applied to the developing agent is small.

The developing agent agitation unit 40 is shaped with an inverted circular cone shape or the like, so that the diameter becomes smaller towards the discharge aperture, and it is provided with a developing agent replenishment aperture 33 on the top surface, and a discharge outlet 34 on the bottom surface. A screw 43 that transports the developing agent from below upwards is provided in the center, and two plate shaped members 44 that are capable of rotating is provided to the outside of the screw 43. The developing agent is mixed by the rotation action of these agitation members 44. The agitation members 44 on the outside and the screw 43 are rotated by an agitation motor 45. The screw 43 is directly connected to the motor, and the agitation members 44 on the outside are rotated via gears 46*a* through 46*d* (the speed is reduced). In the developing agent agitation unit 40, transport from the replenishment aperture 33 to the discharge aperture uses gravitational force. There is always developing agent in the developing agent agitation unit 40 as a buffer, so unmixed developing agent is not discharged as it is.

A spiral shaped auger 35 is provided in the toner supply path 31. The auger 35 is connected at one end to a drive motor 32, which is the source of drive power (see FIGS. 2A and 2B), and is rotationally driven. In this way toner is transported and supplied to the pile of developing agent. The supplied toner is rapidly mixed and agitated together with the developing agent by the agitation members 44 which are the plate shaped members.

As described for the present embodiment, by adjusting (reducing) the amount of charge on the developing agent discharged from the developing unit using the ionized air flow, the dispersability of the replenished toner is improved, so it is possible to rapidly adjust the proper amount of charge without applying unnecessary stress.

The developing agent that is raised from below upwards by the rotation of the screw 43 moves downward with the rotation of the agitation member 44, which rotates to the outside, and again is collected into the periphery of the screw 47. In this way there is continuous circulation of the developing agent within the containing portion of the developing agent agitation unit 40. As a result of this circulation, the developing agent within the whole developing agent agitation unit 40 is uniformly mixed. The toner is charged by friction between the toner and the carrier, so in order to quickly obtain the charging amount, it is important to increase the probability of contact between the toner and the carrier. As a result of research by the inventors of the present invention, it was found that the probability of contact was increased by this circulation of the developing agent within the containing portion of the developing agent agitation unit 40, and that the damage to the developing agent was small. When the amount of charge is reduced before agitation by the ionized air flow, as in the present embodiment, it is possible to uniformly increase the amount of charge on the toner to the appropriate value, so this research has been applied to the agitation device in the present constitution.

The rotary feeder 50 is connected to the bottom of the developing agent agitation unit 40. An impeller 51 is rotatably disposed within the rotary feeder 50 as shown in the drawings, constituted so that a fixed quantity of developing agent is discharged downwards every time. The developing agent discharged from the rotary feeder 50 is entrained in the air flow from left to right as a result of the air delivered from an air pump 60, and transported to the developing unit. The constitution from the air pump 60 to the air intake is as shown in FIGS. 2A and 2B.

The following is an explanation of several modifications of Embodiment 1.

First, Modification 1 is explained with reference to FIG. 8.

In this modification, the ionized air flow inlet 103 is provided in the developing agent supply flow path 4, which is the supply path in the developing agent circulation path from the developing agent agitation unit 40 to the developing unit 2. It is possible to adjust the amount of charge on toner that cannot be used because the amount of charge is too high, weakly charged or oppositely charged toner, and soon, by blowing the ionized air flow onto the developing agent after agitation. This can be done in cases where the amount of charge on the developing agent is too high due to factors from the surrounding environment (for example the temperature and humidity), or when there is variation in the amount of charge (the distribution of the amount of charge is broad) due to degradation of the developing agent or the like. In this case it is possible to adjust the amount of charge to a more appropriate value by adjusting the ion balance of positive ions and negative ions. Also, if the amount of charge on the agitated developing agent is appropriate, the ionizer can be turned off so that energy is not used unnecessarily and generation of ions is stopped. As means for determining whether the amount of charge is appropriate, this can be indirectly inferred from the relationship of the results from a toner concentration sensor provided in the developing unit and an optical sensor that measures the amount of toner adhering to the intermediate transfer belt 85 (see FIG. 1), or the like.

Further, by making the rotational speed of the agitation members 44 of the developing agent agitation unit 40 controllable, it is possible to increase the rotational speed when the amount of charge on the toner is low, and reduce the rotational speed when the amount of charge is high (or stop rotation when not replenishing with toner), in accordance with the conditions of use (environment or output image). In addition, by reducing the amount of charge using the ionized air flow, it is possible to obtain the appropriate amount of charge on the toner, and it is possible to eliminate the occurrence of image quality problems such as unevenness of density or soiling and the like, caused by variation in the amount of charge on the toner. Also, by providing the ionized air flow inlet on both the developing agent discharge flow path 3 and the developing agent supply flow path 4 of the developing agent circulation path, it is possible to more accurately control the amount of charge on the toner.

Figure 9:
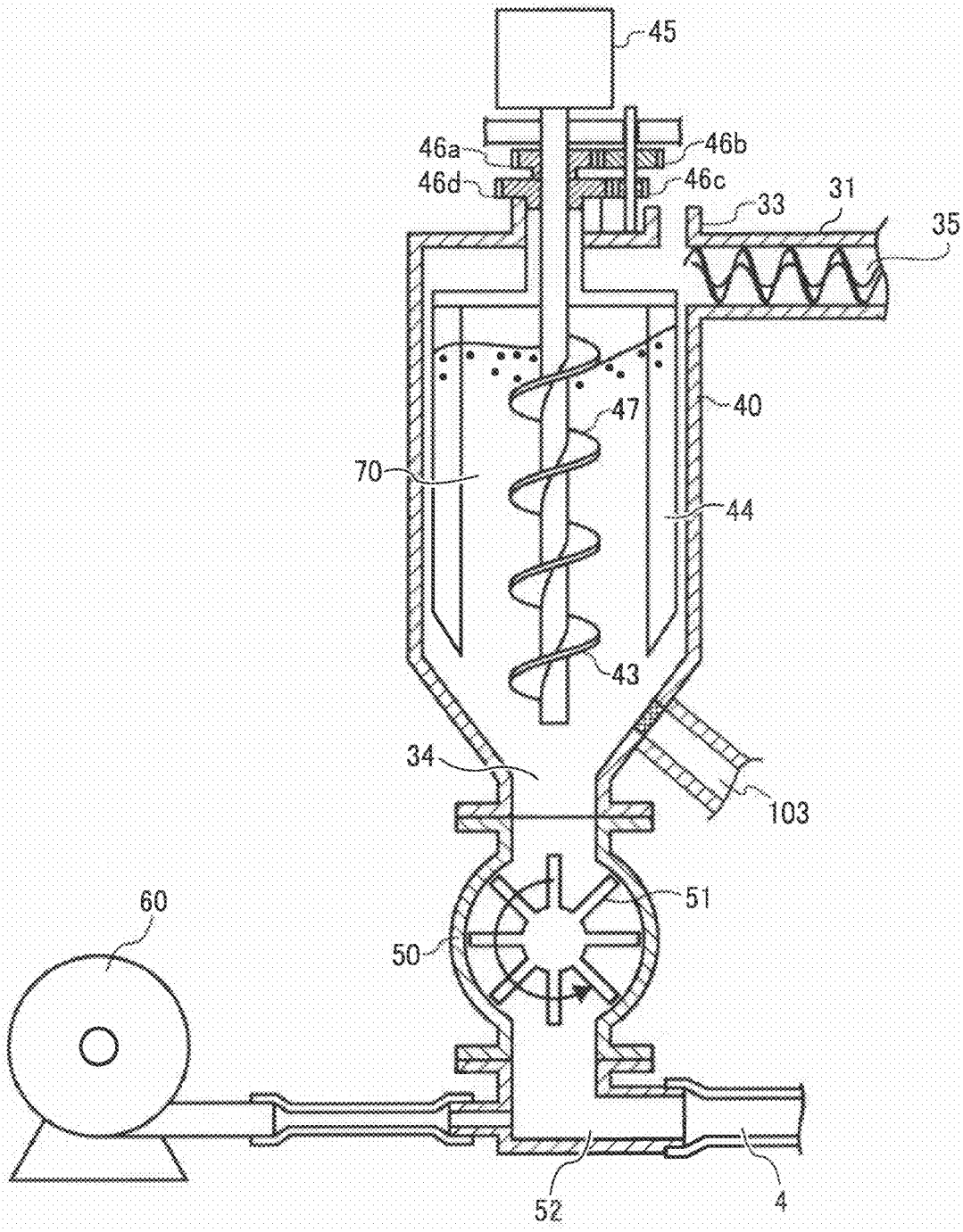
FIG. 9 is a cross-section diagram showing the constitution of Modification 2 of Embodiment 1.

Next, Modification 2 is explained with reference to FIG. 9.

Figure 8:
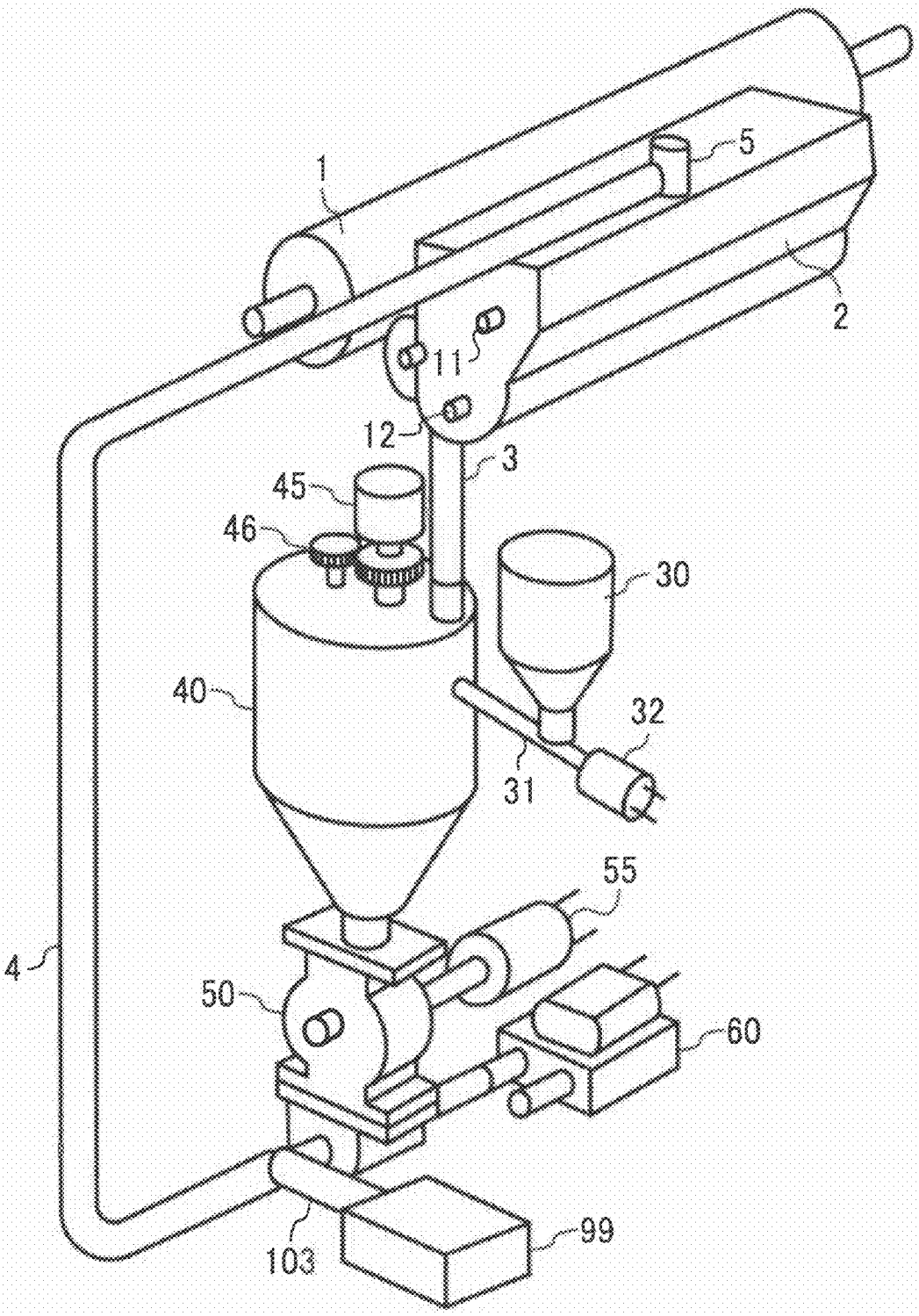
FIG. 8 is a perspective diagram showing the constitution of Modification 1 of Embodiment 1.

In this modification, an ionized air flow inlet 103 is provided in the developing agent agitation unit 40 that has a constitution the same as that of Modification 1, so that the same effect can be obtained as explained for FIG. 8. Further, when the ionized air flow is introduced into the developing agent agitation unit 40, the developing agent within the developing agent agitation unit 40 is fluidized, so the stress due to agitation is reduced, and it is possible to make the concentration and amount of charge of the toner in the developing agent uniform.

Figure 10:
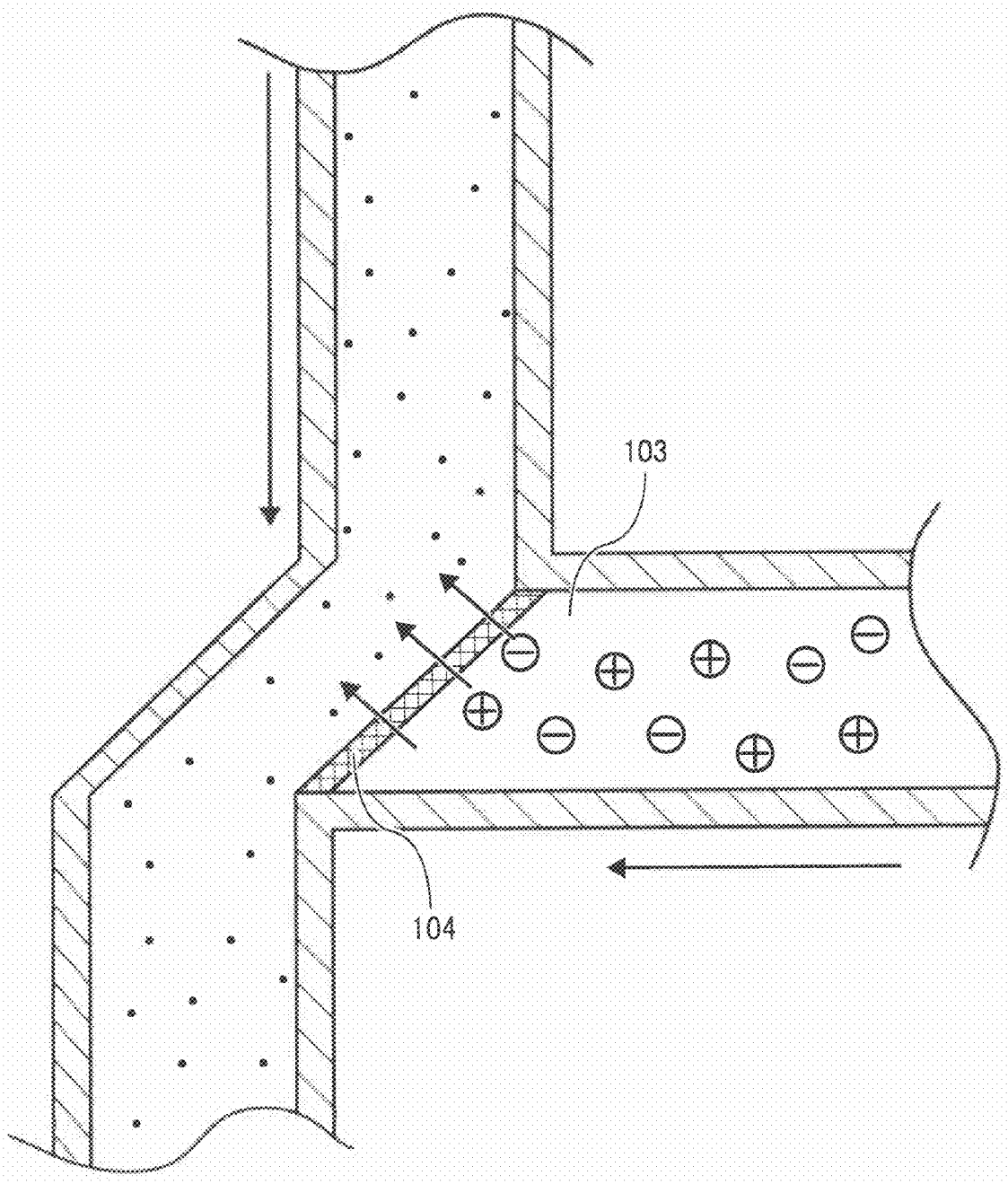
FIG. 10 is a perspective diagram showing the constitution of Modification 3 of Embodiment 1.
Figure 11A:
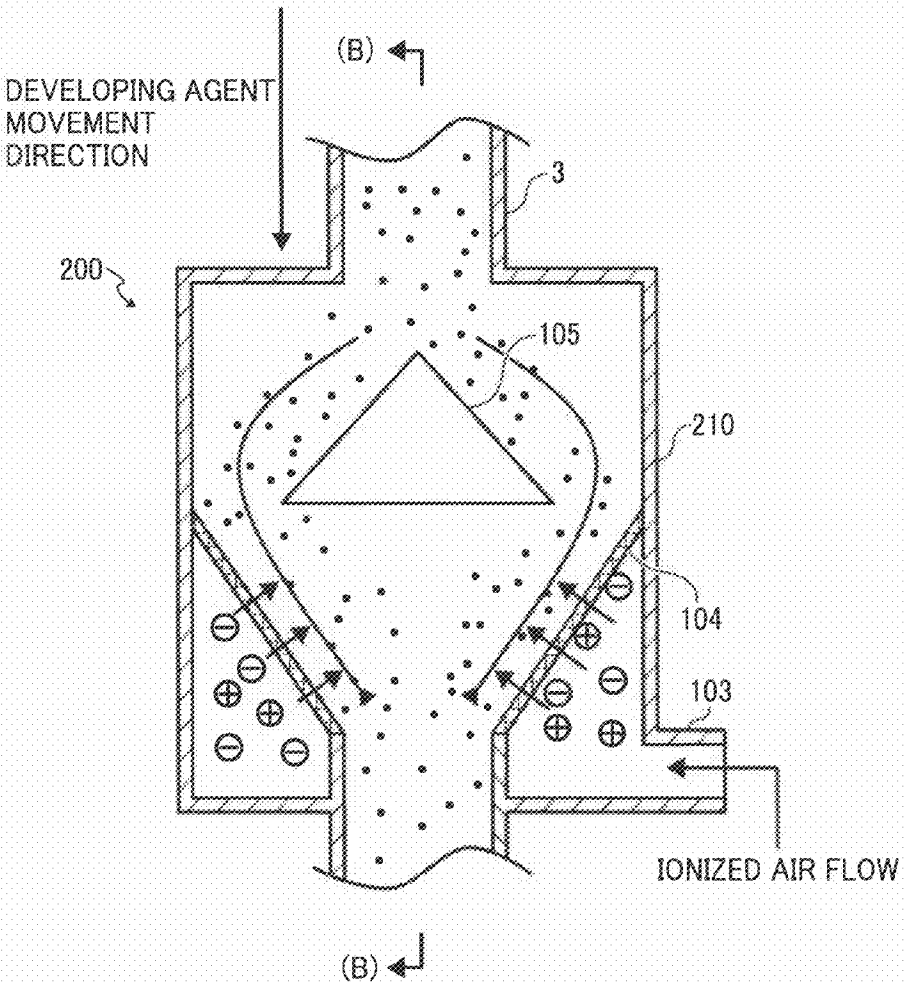
FIGS. 11A and 11B are cross-section diagrams showing the constitution of Modification 4 of Embodiment 1.
Figure 11B:
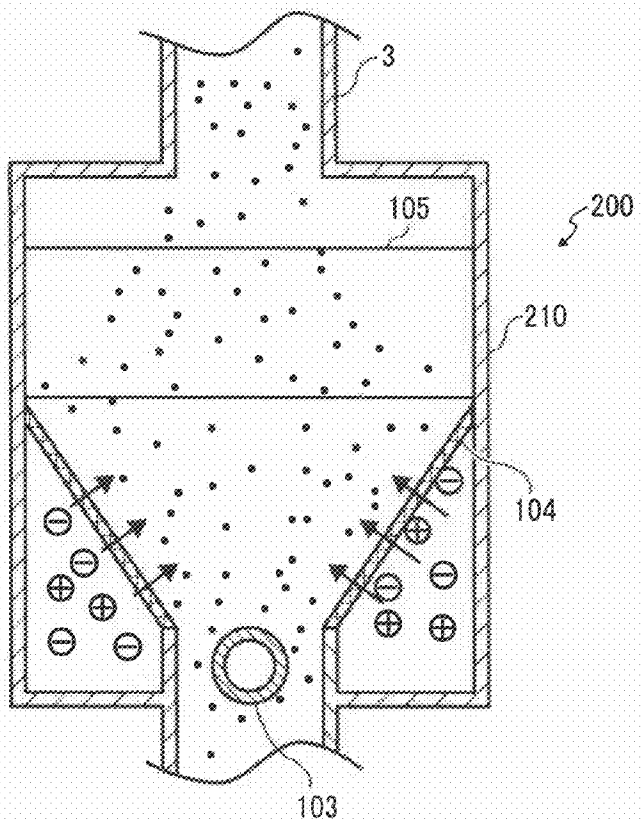
Figure 12A:
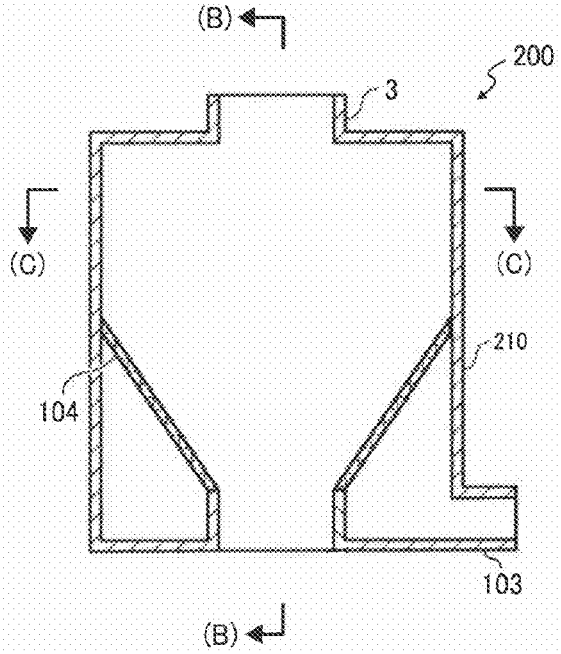
FIGS. 12A to 12C are diagrams showing the constitution of the pre-mixing unit used in Modification 4.
Figure 12B:
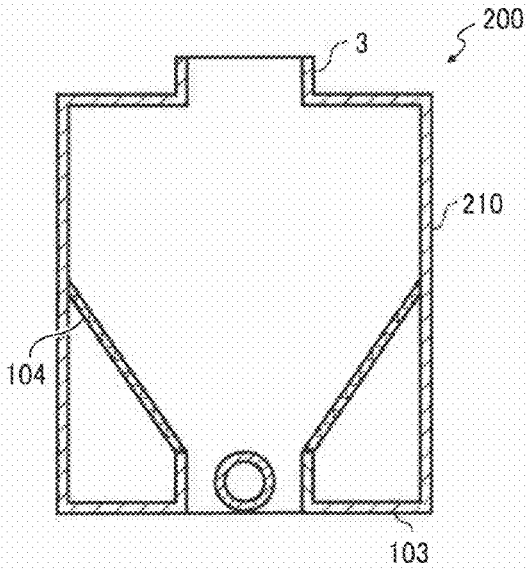
Figure 12C:
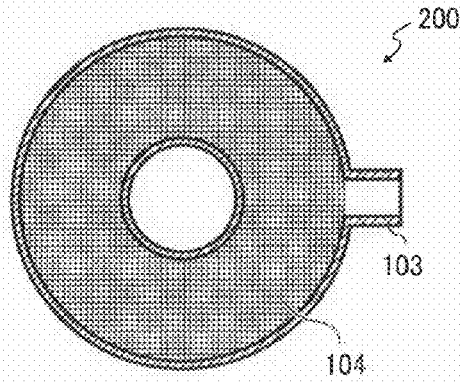

Next, Modification 3 is explained with reference to FIG. 10.

In this modification, it is possible to reduce reverse flow of developing agent into the inlet or reduce blockages of the inlet by providing a mesh or porous plate 104 through which the carrier cannot pass on the ionized air flow inlet 103. Also, the porous plate 104 is disposed at an incline with respect to the flow of the developing agent, so that the ions are introduced in a direction that resists the direction of flow of the developing agent. If the ionized air flow is simply introduced from the side relative to the direction of movement of the developing agent as shown in FIG. 5, the ions are introduced to only a part of the developing agent, so the introduction of ions is insufficient. In contrast if the ions are introduced from a direction that resists the direction of flow of the developing agent, as in the present modification, it is possible to introduce the ions to the developing agent uniformly and without unevenness.

Next, Modification 4 is explained with reference to FIGS. 11A, 11B, 12A through 12C, and 13.

Figure 13:
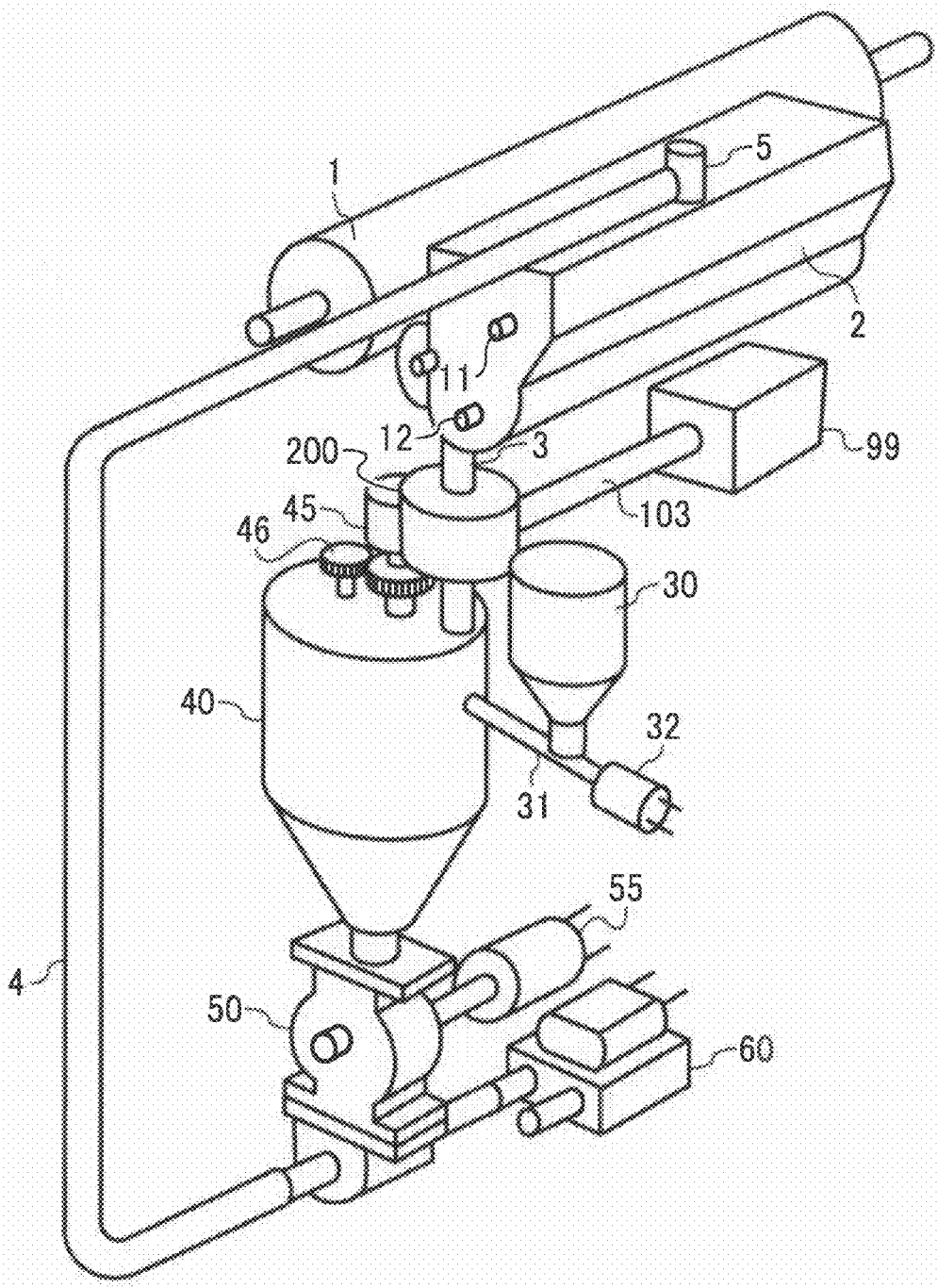
FIG. 13 is a perspective diagram showing the detailed constitution of the developing unit, the developing agent agitation unit, the rotary feeder unit, and the air pump of Modification 4.

In this modification, the developing agent discharge flow path 3 is connected to the developing agent agitation unit 40 via a premixing unit 200, as shown in FIG. 13. The ionized air flow inlet 103 is connected to and ionized air flow is introduced into the premixing unit 200, so the developing agent within the developing agent discharge flow path 3 is ionized. As shown in FIGS. 11A, 11B, and 12A through 12C, the premixing unit 200 includes a developing agent dispersal member 105 and a mesh 104 disposed within a housing 210 formed in a circular cylindrical shape. The mesh 104 has an inverted conical shape within the housing 210, so that it is possible to introduce the ionized air flow in opposition to the direction of circulation of the developing agent. Also, the developing agent dispersal member 105 is a roof shaped member with two slanting surfaces on the top relative to the direction of movement of the developing agent (in this case the downward direction), that effectively disperses the developing agent so that it impinges on the ionized air flow.

Figure 14A:
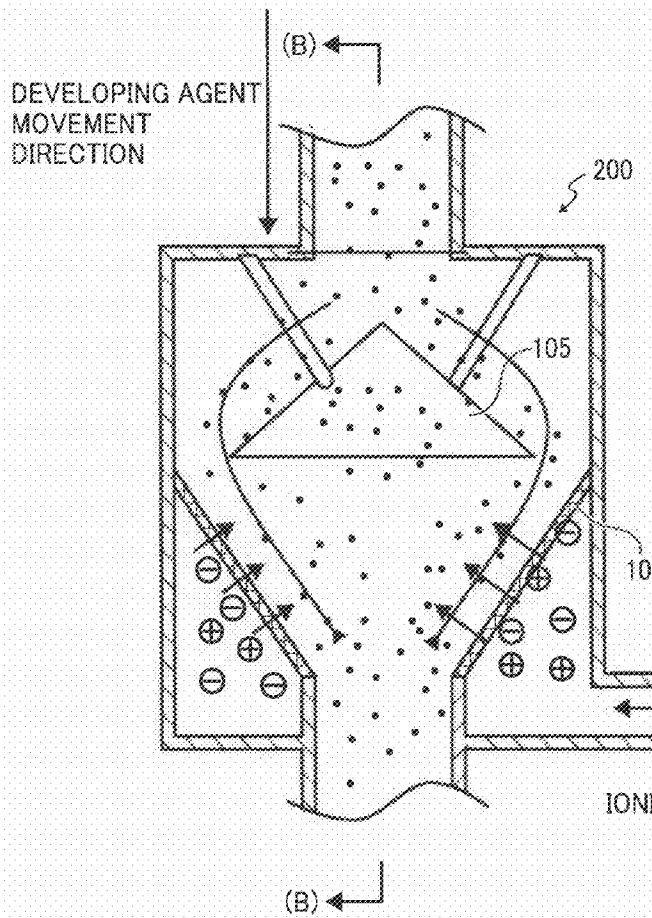
FIGS. 14A and 14B are cross-section diagrams showing the constitution of a further modification to Modification 4.
Figure 14B:
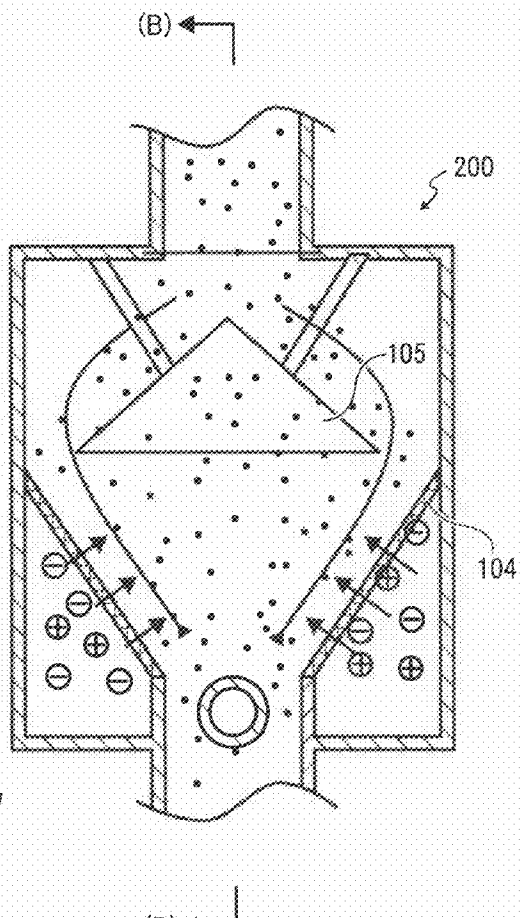

In the present modification, when the developing agent that has been dispersed on the side surface side of the mesh 104 in this way moves above the mesh 104, the mesh 104 acts as a fluidized bed, and it is possible to introduce the ionized air flow into all the developing agent. Also, as shown in FIG. 14, in the present modification, the developing agent dispersal member 105 is formed in the shape of a circular cone with the apex pointing upwards. When the developing agent dispersal member 105 has a conical shape, as in the present modification, the developing agent is easily dispersed uniformly, so it is possible to uniformly blow the ionized air flow against the developing agent. Besides a circular conical shape, the developing agent dispersal member 105 may be a pyramidal shape, such as a triangular pyramid or a rectangular pyramid or the like.

Figure 15:
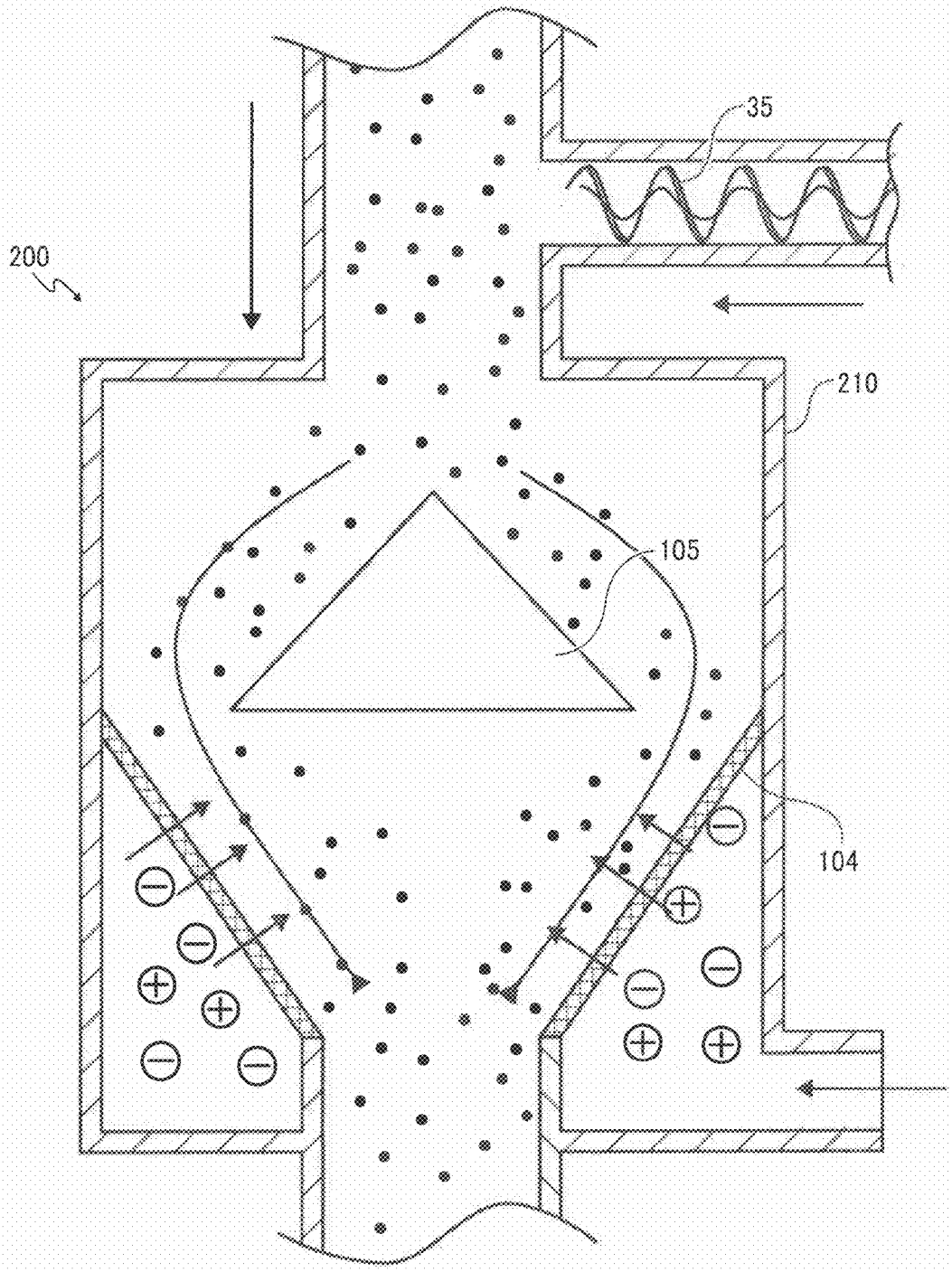
FIG. 15 is a cross-section diagram showing the constitution of Modification 5 of Embodiment 1.

Next, Modification 5 is explained with reference to FIG. 15.

In this modification, the toner replenishment aperture is provided on the upstream side of the ionized air flow inlet on the discharge path from the developing unit to the agitation unit, and by rotating the auger 35, toner is supplied from the toner supply path 31. The replenished toner moves through the circulation path together with the developing agent discharged from the developing unit, and is dispersed into the developing agent at the ionized air flow inlet. The ions are attracted to the charged toner and carrier in priority, so their charge is reduced, so the newly replenished toner can be easily dispersed. Also, because this serves the role of premixing, the subsequent mixing and agitation in the agitation unit can be easily carried out, so it is possible to reduce the stress to the developing agent in the agitation unit.

When the premixing unit 200 described in Modifications 4 and 5 is used, the developing agent dispersal member 105 may be made from metal or resin. Also, to prevent the ions from being eliminated by impacting each other before being blown against the developing agent, or to prevent them from being absorbed on the sides of the container, a bias voltage is applied to the developing agent dispersal member 105, so that it is possible to apply an electrical driving force to the ions in addition to that of the air. Further, the agitation effect can be improved by rotating the developing agent dispersal member 105 about a rotational axis normal to the direction of the gravitational force. Also, in the above examples the ionized air flow inlet 103 is at one location only, but ionized air flow inlets 103 may be provided at a plurality of locations, so that it is possible more uniformly blow the ionized air flow against the developing agent.

Also, as stated above, in FIGS. 2A and 2B (and also in FIG. 8) developing agent discharged from the rotary feeder 50 is entrained in the air flow fed from left to right by the air delivered from the air pump 60 and transported to the developing unit. Transport of this developing agent may be carried out using the ionized air flow from the ionizer 99 instead of the air pump 60, so there is no necessity to provide the separate pump, and it is possible to simplify the developing device.

Figure 16A:
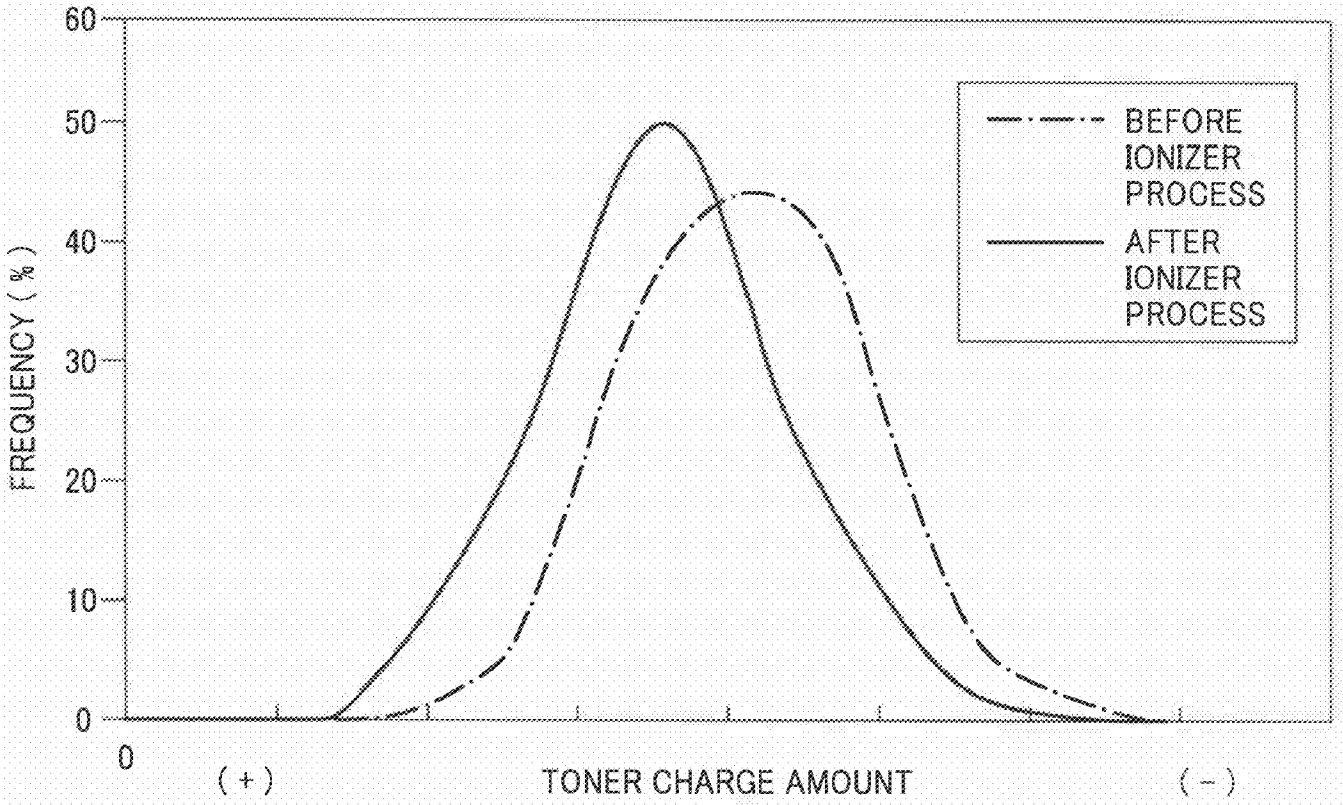
FIGS. 16A and 16B are diagrams showing examples of tests for control of the amount of charge using the ionized air flow.
Figure 16B:
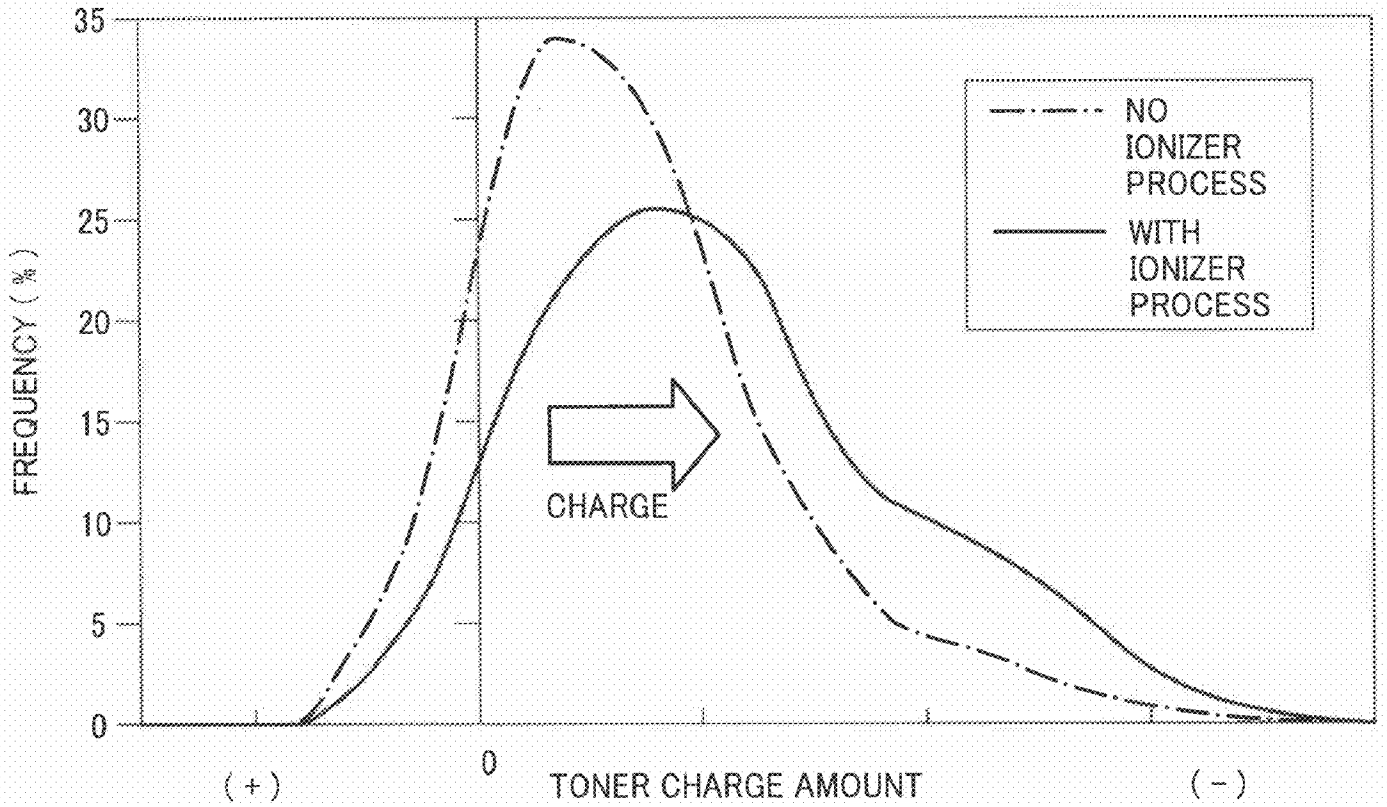
Figure 17:
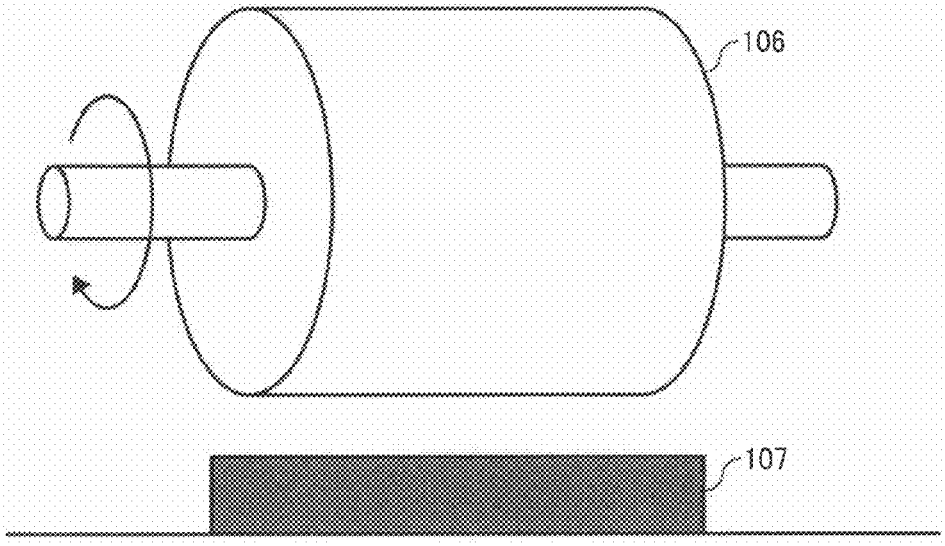
FIG. 17 is a diagram for explaining agitation of developing agent (toner and carrier) within a circular cylindrical shaped container that is rotated about the axis of the circular cylinder using the rotational motion and the magnetic force from the container side surface.

FIGS. 16A and 16B are graphs showing examples of tests to control the amount of charge using the ionized air flow, and FIG. 17 shows the cylindrical container and side surface magnet used in the tests shown in FIGS. 16A and 16B.

The test conditions were as follows.

Developing agent: toner particle diameter 6 μm, carrier particle diameter 35 μm

Agitation device: Cylindrical container 106 rotated about the axis of the cylinder, and the developing agent (toner and carrier) within the container is agitated by the rotational motions and the magnetic force from a side surface magnet 107 disposed to the side of the cylinder (FIG. 17).

Cylindrical container: Diameter ϕ30 mm, height 40 mm, rotational speed 180 rpm

Side magnet: 1000 G, 3000 G

FIG. 16A shows the results when 5 g of developing agent with 4 wt % toner concentration is agitated for 20 minutes in the above agitation device with a 3000 G side magnet fitted. The distribution of the amount of charge on the toner was measured using a charge measuring device (product name E-spart analyzer) for developing agent on which ionized air was not blown after agitation (before ionizer processing) and developing agent on which ionized air was blown after agitation (after ionizer processing). The developing agent that was just agitated was strongly agitated, so there was a broad distribution on the high charge side. This type of developing agent has strong adhesion forces between the toner and the carrier, so development does not occur within the developing unit, which causes the problem of light image density. On the other hand, the developing agent that was exposed to the ionized air flow had a lower charge amount, and further the charging distribution was sharper. Therefore it can be seen that the amount of charge was adjusted to the appropriate amount for developing, and it is considered that the developing efficiency is improved.

FIG. 16B shows the results when 4 g of the above two types of developing agent (without ionizer processing, with ionizer processing) is replenished with new toner to a toner concentration of 7 wt %, and agitated for one minute in the agitation device with the 1000 G side magnet fitted. It can be seen that compared with the developing agent without the ionizer processing, the developing agent with the ionizer processing has been shifted to the high charge side, so it can be seen that charging occurs rapidly. This is because the new toner is rapidly dispersed in the toner (developing agent) that has been subjected to strong stress from strong agitation, so it is considered that agitation was carried out better compared with the developing agent without the ionizer process.

In this way it was confirmed that by introducing the ionized air flow before agitation, the dispersability of the replenished toner is improved, and by introducing the ionized air flow after agitation it is possible to adjust the toner having an inappropriate amount of charge to the appropriate amount of charge.

Next, Modification 6 is explained with reference to FIGS. 18A and 18B.

Figure 18A:
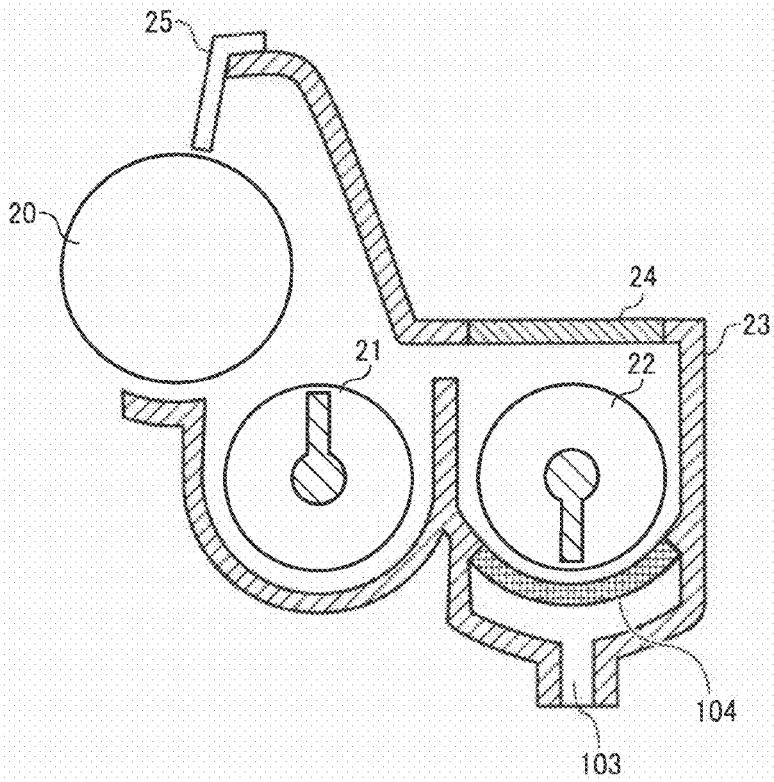
FIGS. 18A and 18B are cross-section diagrams showing the constitution of Modification 6 of Embodiment 1.
Figure 18B:
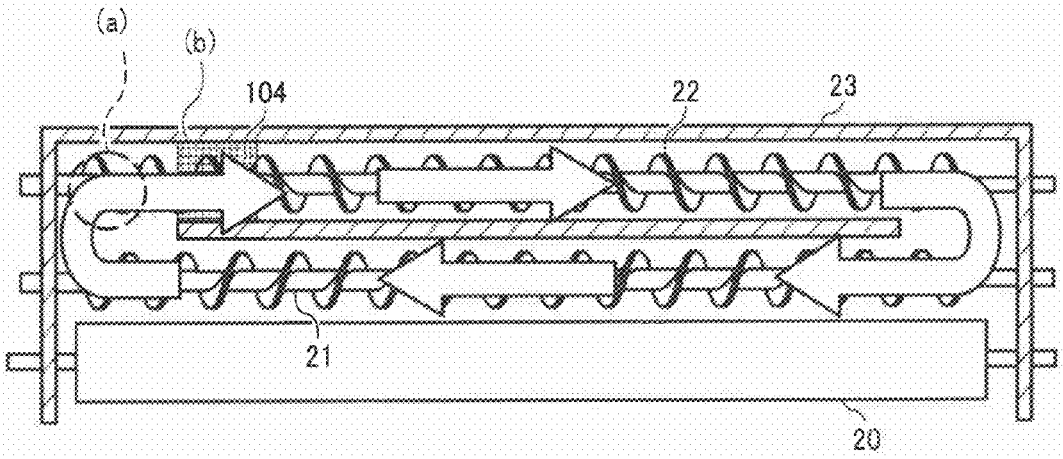

FIG. 18A shows a cross-section through the developing unit in the axial direction, and FIG. 18B shows a cross-section from above. In the figure, 20 is a developing roller within which a magnet is disposed, which acts to attract the developing agent and transport it to the surface of the photosensitive member 1 so that the toner adheres to the electrostatic latent image. In the figure, 21 is a first transport screw, and 22 is a second transport screw. The first transport screw 21 is driven so that it transports in the length direction from right to left in FIG. 18B, and supplies developing agent to the developing roller 20. The second transport screw 22 is rotationally driven so that developing agent is transported from left to right, and during transport, at (a) in FIG. 18B the replenished toner is mixed and agitated while the developing agent is transported.

In the figure, 25 is a doctor blade for uniformly leveling the developing agent adhering to the developing sleeve to a constant amount, and 23 is a casing that covers the developing unit. Further, in the present modification the ionized air flow inlet is provided below the second transport screw 22. Toner is replenished from above at position (a) in the figure, and at position (b) is fluidized by the ionized air flow flowing in from below and the mesh 104, and ions are introduced (the air flow that is introduced is discharged to the outside from a filter 24 provided on the top). The amount of charge on the developing agent into which the ions are introduced is reduced (and the difference in electrostatic adhesion force between the toner and carrier for the replenished toner and the toner in the developing agent is reduced), so the replenished toner is easily mixed and dispersed into the developing agent. Also, variation in the amount of charge itself is reduced, so developing agent that has a uniform toner concentration and amount of charge is transported by the second transport screw 22, and supplied by the first transport screw 21 to the developing roller 20. At this time, the toner concentration and amount of charge are the appropriate amounts, so it is possible to maintain a stable image density with time.

Here, the reason the ionized air flow inlet 103 is provided slightly downstream of the toner replenishment aperture is to prevent the replenished toner from being blown upwards by the ionized air flow. The specific gravities of toner and developing agent are different, so when a large quantity of toner is being replenished the replenished toner will not mix with the developing agent, and upward sliding is caused. However, when the inlet is directly below the toner replenishment aperture it is considered that this effect is further assisted by the air flow, so in this constitution it is possible to prevent upward sliding.

Next, Modification 7 is explained with reference to FIGS. 19A through 19C.

Figure 19A:
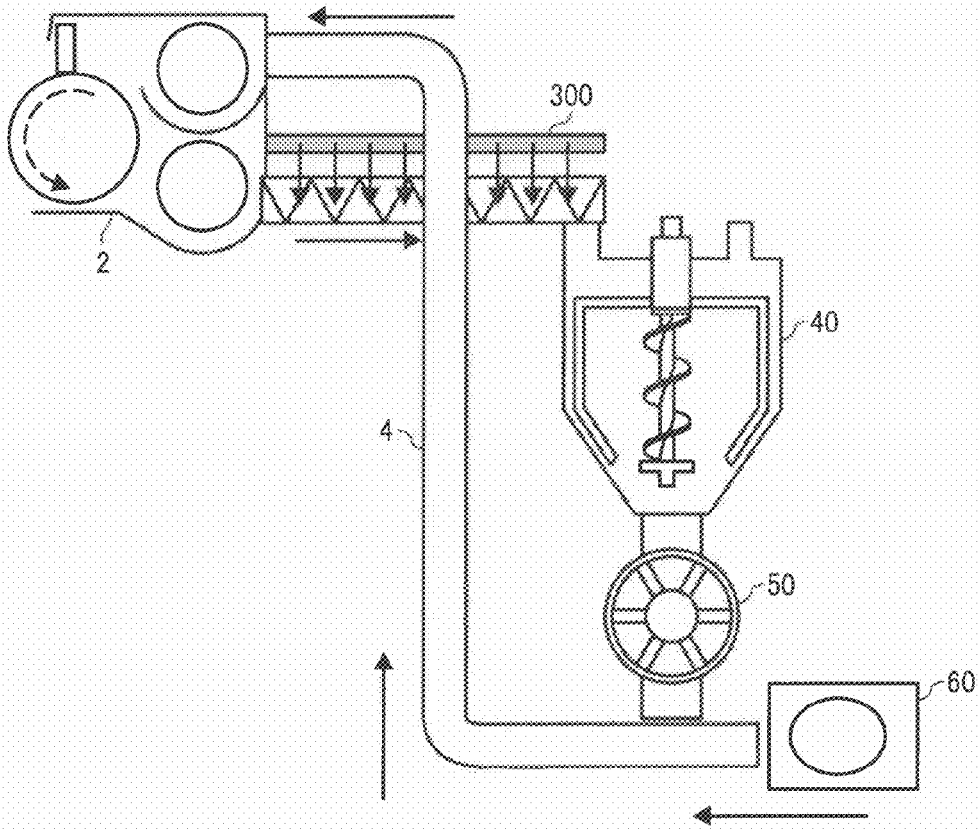
FIGS. 19A to 19C are cross-section diagrams showing the constitution of Modification 7 of Embodiment 1.
Figure 19B:
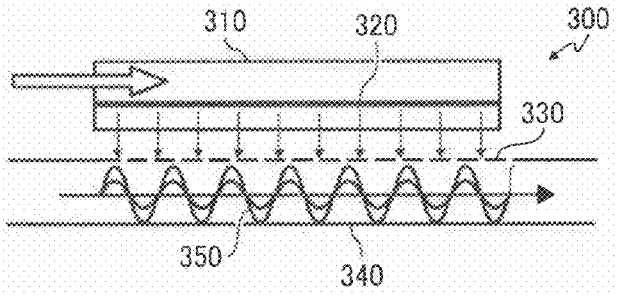
Figure 19C:
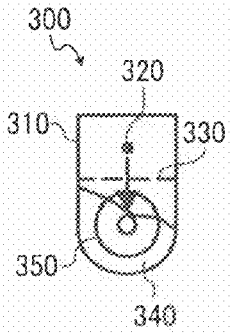

FIG. 19A shows the constitution of the developing unit, the developing agent agitation unit, the rotary feeder, and the air pump, FIG. 19B shows the constitution of a decharger, and FIG. 19C shows the constitution of the decharger.

In the present modification, a charger 300 is disposed above the developing agent discharge path 340 that is disposed between the developing unit 2 and the developing agent agitation unit 40, with a porous plate 330 disposed therebetween, so that an ionized air flow generated by the charger 300 is fed to developing agent passing through the developing agent discharge path 340. In the charger 300, a cable 320 is disposed within a case 310 into which air is introduced, and a bias voltage of for example 3 kV or more is applied between the case 310 and the cable 320, so that the ions generated by electrical discharge are carried away by the air. In the figure, 350 indicates a screw for transporting the developing agent.

According to tests carried out by the four inventors, when the charger according to the present modification is used the quantity of ions generated is greater than for a normal ionizer, so the result that a high decharging effect per unit time can be obtained.

As explained above, in the developing device that uses developing agent that includes toner and carrier, provided with a developing unit and a developing agent agitation unit that are separate from each other, in which developing agent is circulated between the developing unit and the developing agent agitation unit, and has ionized air flow generation means, by providing an ionized air flow inlet for adjusting (reducing) the amount of charge on the toner and carrier in the discharge path on the developing agent circulation path from the developing unit to the developing agent agitation unit, it is possible to improve the dispersability of the replenished toner, improve the agitatability, and stabilize the amount of toner charge. In other words, in the conventional electrophotographical developing unit, there is toner that has not been consumed but has been subject to stress in the developing unit, and newly replenished fresh toner (the toner within the developing agent within the developing unit has different histories). Under this situation with the different toners (toner in which the additives have been embedded or removed so their status differs, and so on), if the replenished toner is mixed in and agitated, the amount of charge will vary. As a result the electrostatic adhesion force will vary, so strongly charged toner that cannot be used in developing and weakly charged toner that badly affects the image quality will be generated. To solve this problem, the amount of charge is adjusted before agitation, and the amount of charge on the replenished toner and the toner within the developing device is made uniform (by for example reducing the amount of charge). As a result the difference in the electrostatic adhesion force between the toner and the carrier is made small, so the mixability and dispersability of the replenished toner is improved, and the distribution of the amount of charge on the toner after agitation is stabilized, so it is possible to maintain stable image quality. Also, ions can be introduced uniformly in the developing agent by introducing an ionized air flow as means for adjusting the amount of charge.

The following are the characteristics and effects of Embodiment 1 and Modifications 1 through 7 as described above.

(1) In the developing device that uses developing agent that includes toner and carrier, provided with a developing unit and a developing agent agitation unit that are separate from each other, in which developing agent is circulated between the developing unit and the developing agent agitation unit, and has ionized air flow generation means, by providing an ionized air flow inlet for adjusting (reducing) the amount of charge on the toner and carrier in at least one side of the developing agent agitation unit in the discharge path on the developing agent circulation path from the developing unit to the developing agent agitation unit, it is possible to stabilize the amount of toner charge. In other words, the amount of charge can be too high due to excessive agitation during repeated circulation within the developing device, and the amount of charge can vary even with the same agitation conditions due to variations in the conditions of use (changes in the surrounding environment or the area of image output). Therefore, by adjusting (reducing) the amount of charge on the toner (developing agent) using an ionized air flow, it is possible to reduce the proportion of strongly charged toner that cannot be used in developing. Also, the distribution of the amount of charge is made sharp, so it is possible to maintain stable image quality over time.

(2) Also, it is possible to arbitrarily turn the ionized air flow generation means on or off, and it is possible to arbitrarily control the ion balance between positive ions and negative ions. Therefore it is possible to adjust the amount of charge to the appropriate amount, so by operating the ionizer in accordance with the state of the developing agent within the developing device (toner concentration and amount of charge), and altering its ion balance, it is possible to maintain the appropriate amount of charge without unnecessarily introducing ions into the developing agent.

(3) Also, by providing a mesh, porous plate, or alternative member through which the carrier cannot pass in the ionized air flow inlet, ions can be uniformly introduced into the developing agent. By providing a mesh or porous plate through which the carrier cannot pass, it is possible to prevent back flow of developing agent into the inlet, and uniformly introduce the ions into the developing agent.

(4) Further, by introducing the ionized air flow into the developing agent circulation from a direction that resists the circulation direction of the developing agent, the ionized air flow can be uniformly fed into the whole developing agent. If the ionized air flow is introduced from the side of the circulation direction of the developing agent, the ions are introduced into only a part of the developing agent. Also, by incorporating the mesh or porous plate, it is possible to fluidize the developing agent, so the ions can be dispersed more uniformly.

(5) Further, the toner dispersability and agitatability can be improved by providing the toner replenishment aperture on the discharge path from the developing unit to the developing agent agitation unit, upstream from the ionized air flow inlet. By premixing the replenished toner and the developing agent using the ionized air flow, it is possible to uniformly disperse the toner in the developing agent, and subsequently the agitation can be carried out efficiently.

(6) Further, by making it possible to arbitrarily control the rotation speed of the agitation member of the agitation unit, it is possible to stabilize the amount of charge on the toner. When the amount of charge is low, it can be raised by increasing the rotational speed of the agitation member, and conversely, when it is high the amount of charge can be reduced using the ionizer. Therefore it is possible to stably obtain the appropriate amount of charge when necessary.

(7) By using the ionized air flow (air) as the developing agent transport means, it is possible to simplify the device. When air transport is used as the developing agent transport means, a single pump can be shared for the air for transport and the air for carrying the ions (air flow), so it is possible to simplify the constitution of the device.

(8) In developing devices that use two-component developing agent that includes toner and carrier, when means for generating an ionized air flow is provided, by providing the ionized air flow inlet in the developing agent (toner) agitation unit, the dispersability and agitatability of the replenished toner can be improved, and the amount of charge on the toner stabilized. In a constitution in which the agitation unit and the developing unit are not provided as separate, it is also possible to adjust the dispersability and the amount of charge on the replenished toner by blowing the ionized air flow against the developing agent when agitating. In other words, it is possible to obtain the desired effect without providing the developing unit and the agitation unit as separate (for example, a conventional developing device that agitates while transporting with a screw).

In this way, according to the present invention, it is possible to mix and agitate replenished toner and developing agent in a short period of time, efficiently, and without causing unnecessary stress, and efficiently adjust the amount of charge on the developing agent without being affected by usage or external disturbing conditions or the like, and continuously supply the developing unit with developing agent having the appropriate toner concentration and amount of charge in just the quantity required for developing.

Embodiment 2

The following is an explanation of Embodiment 2 of the present invention, with reference to the drawings.

As stated above, the reference numerals used in the Embodiment 2 are independent of the reference numerals of the above Embodiment 1 and the Modifications 1 through 7.

Figure 20:
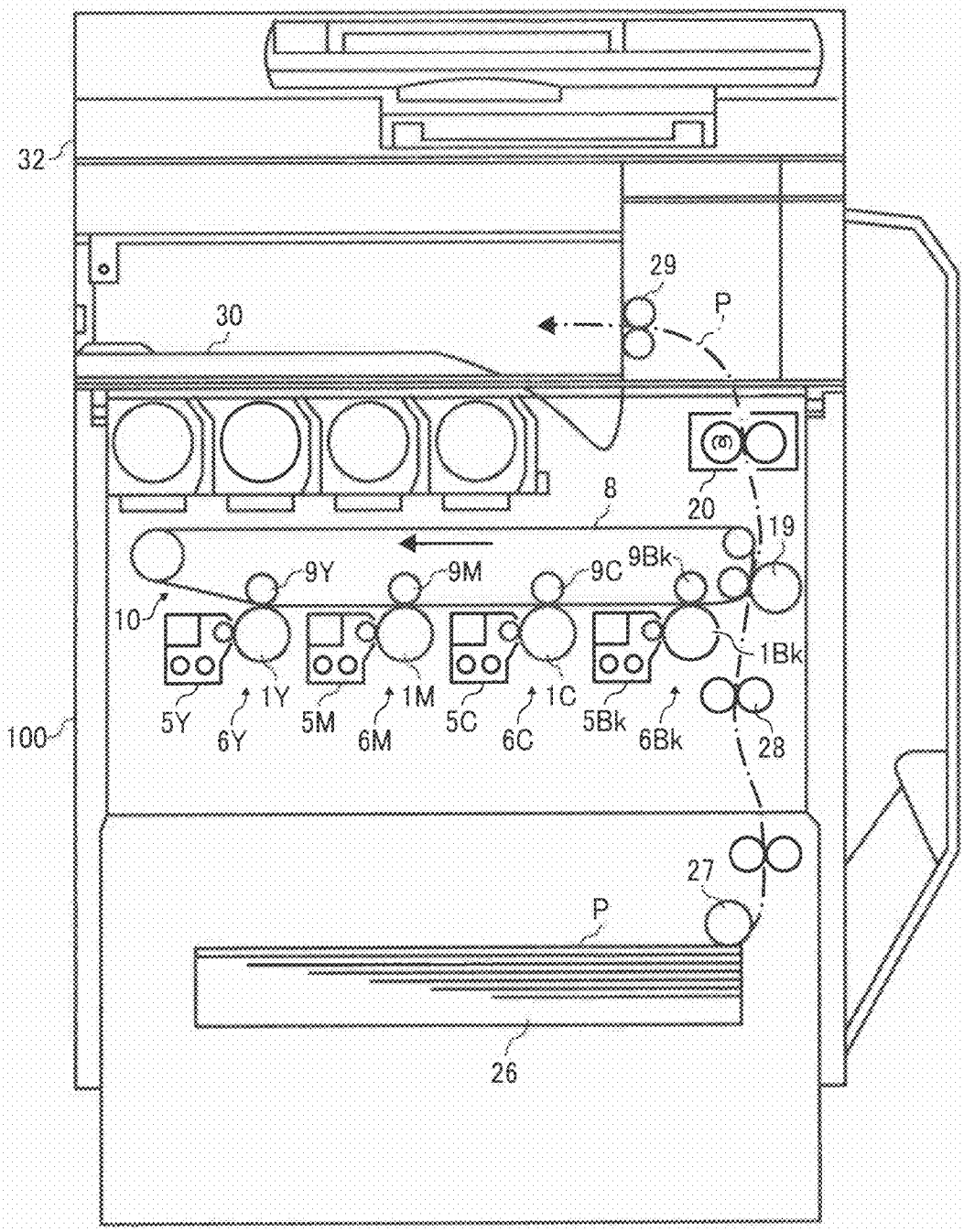
FIG. 20 is a cross-section diagram showing the overall constitution of an image forming apparatus according to Embodiment 2 of the present invention.

FIG. 20 shows the constitution of an image forming apparatus using the developing device according to the present embodiment.

The image forming apparatus shown in the figure includes image forming units 6Y, 6M, 6C, 6Bk corresponding to each color (yellow, magenta, cyan, black) disposed in a row in opposition to the bottom surface of an intermediate transfer belt 8, which is the unfixed image carrier in an intermediate transfer unit 10. These image forming units 6Y, 6M, 6C, 6Bk have the same structure apart from the different color of toner used in each image forming process.

Each image forming unit 6 includes a photosensitive drum 1 as latent image carrier, and charging means (not shown on the drawings) a developing device 5, cleaning means (not shown on the drawings), and so on, disposed around the periphery of the photosensitive drum 1.

Image forming processes (a charging process, a light exposure process, a developing process, a transfer process, and a cleaning process) are carried out on the photosensitive drum 1, and toner images are formed on the photosensitive drum 1.

The photosensitive drum 1 is rotationally driven in the clockwise direction in the drawing, by a drive unit which is not shown on the drawings, and at the position of the charging process the surface is uniformly charged (charging process). When the surface of the photosensitive drum 1 arrives at the laser light illumination position of light emitted from a light exposure unit, which is not shown on the drawings, an electrostatic latent image is formed by a light exposure scan at this position (light exposure process). When the surface of the photosensitive drum 1 arrives at a position in opposition to the developing device 5, the developing process is carried out to form a visible image using toner contained in developing agent supplied by the developing device 5.

When the surface of the photosensitive drum 1 carrying the toner image that was processed to become visible in the developing process arrives at the position in opposition to the intermediate transfer belt 8 and a primary transfer bias roller 9, the toner image on the photosensitive drum 1 at this position is transferred onto the intermediate transfer belt 8 (primary transfer process).

When the surface of the photosensitive drum 1 after transfer is completed arrives at the position in opposition to the cleaning means, and at this position untransferred toner that remains on the photosensitive drum 1 is recovered (cleaning process). After cleaning, the voltage of the surface of the photosensitive drum 1 is initialized by a decharging roller, which is not shown on the drawings. By passing through these processes, the series of image forming processes carried out on the photosensitive drum 1 is completed.

As shown in FIG. 20, the image forming processes described above are carried out in each of the four image forming units 6Y, 6M, 6C, 6Bk. In other words, laser light based on image information emitted from the light exposure unit (optical writing device), which is not shown on the drawings, disposed below the image forming units is emitted towards the photosensitive drums of each image forming unit 6Y, 6M, 6C, 6Bk. Then, after passing through the developing process, the toner images in each color formed on the photosensitive drums are transferred and superimposed onto the intermediate transfer belt 8. In this way, a full color image is formed on the intermediate transfer belt 8.

The four primary transfer bias rollers 9Y, 9M, 9C, 9Bk form primary transfer nips in which the intermediate transfer belt 8 is sandwiched between the photosensitive drums 1Y, 1M, 1C, 1Bk. A transfer bias having the opposite polarity to the polarity of the toner is applied to the primary transfer bias rollers 9Y, 9M, 9C, 9Bk. The intermediate transfer belt 8 moves in the direction of the arrow, and successively passes the primary transfer nip of each primary transfer bias roller 9Y, 9M, 9C, 9Bk. In this way, the toner image in each color on the photosensitive drums 1Y, 1M, 1C, 1Bk are superimposed and primarily transferred on the intermediate transfer belt 8.

The intermediate transfer belt 8 on which the toner images in each color have been transferred and superimposed then arrives at a position in opposition to a secondary transfer roller 19, which is secondary transfer means. The color toner image formed on the intermediate transfer belt 8 is transferred in one operation onto a transfer sheet P as recording medium that is transported to the position of the secondary transfer nip.

A plurality of stacked transfer sheets P is housed in a sheet supply unit 26 disposed in the bottom of the main body of the apparatus 100, and sheets are supplied by a sheet supply roller 27, which separates one sheet at a time. The supplied transfer sheet P is temporarily stopped at a pair of registration rollers 28, and after correcting any tilt or shifting, the transfer sheet P is fed by the pair of registration rollers 28 at a predetermined timing towards the secondary transfer nip. Then, as described above, at the secondary transfer nip the required color image is transferred onto the transfer sheet P.

The transfer sheet P on which the color image has been transferred at the secondary transfer nip is transported to a fixing unit 20, and here the color image transferred onto the surface is fixed by heat and pressure from a fixing roller and a pressure roller.

The transfer sheet P on which fixing has been completed is discharged as an output image by a pair of sheet discharge rollers 29 onto a sheet discharge unit 30 formed on the top surface of the main body of the apparatus, and stacked. With this the series of image forming processes in the image forming apparatus is completed. In FIG. 20, reference numeral 32 indicates a reading unit.

Next, the constitution of the developing device according to the present embodiment is explained.

Figure 21:
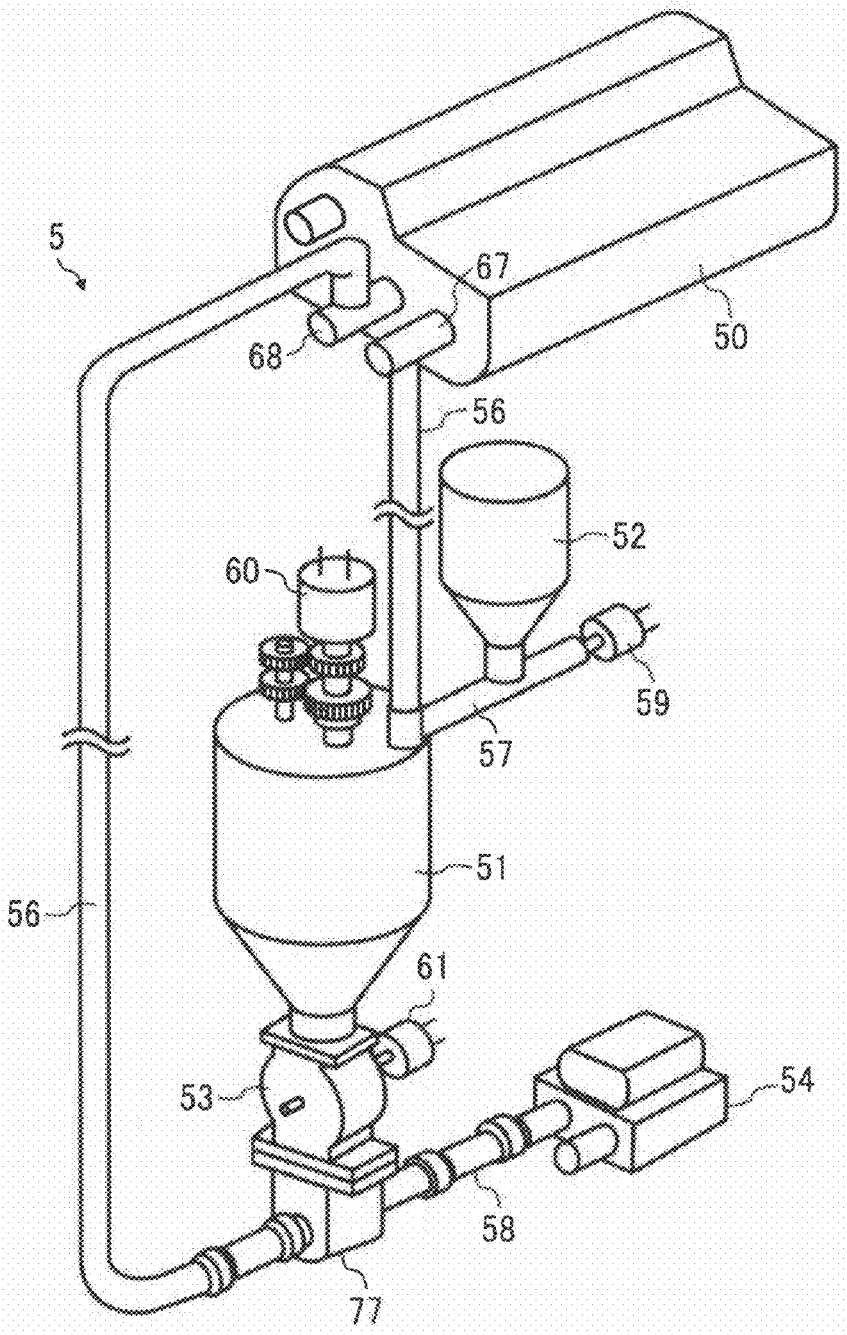
FIG. 21 is a schematic diagram showing the overall constitution of the developing device of this image forming apparatus.

The developing device in FIG. 21 is explained in detail later, but the developing device includes a developing unit that executes the developing process on the photosensitive drum using two-component developing agent that is a mixture of carrier and toner, and a circulation unit that delivers developing agent recovered from the developing unit again to a developing agent supply unit of the developing unit.

In FIG. 21, the developing device 5 includes a developing unit 50 that develops the electrostatic latent images on the photosensitive drum 1, a developing agent agitation unit 51 positioned separately from the developing unit 50, and that agitates and mixes developing agent recovered from the developing unit 50 and new toner to compensate for the consumed toner, a toner cartridge 52 that supplies new toner to the developing agent agitation unit 51, a rotary feeder 53 for delivering the developing agent discharged from the developing agent agitation unit 51 after agitation and mixing, and an air pump 54 that corresponds to a developing agent circulation drive source that delivers the developing agent to the developing unit 50 by air pressure. In FIG. 20, the developing unit 50 has a cartridge shape.

The developing unit 50 and the developing agent agitation unit 51 are connected by a circulation path 56 that forms the circulation unit. The circulation path 56 includes an outward part in which developing agent recovered from the developing unit 50 reaches the developing agent agitation unit 51, and a return part that corresponds to the developing agent supply portion from the developing agent agitation unit 51 to the developing unit 50 and that links with one end of a transport screw. In FIG. 21, reference numeral 59 indicates a motor that is the toner replenishment drive source, reference numeral 60 is a motor that is an agitation drive source, and reference numeral 61 is a motor that is the drive source of the rotary feeder 53.

Figure 22:
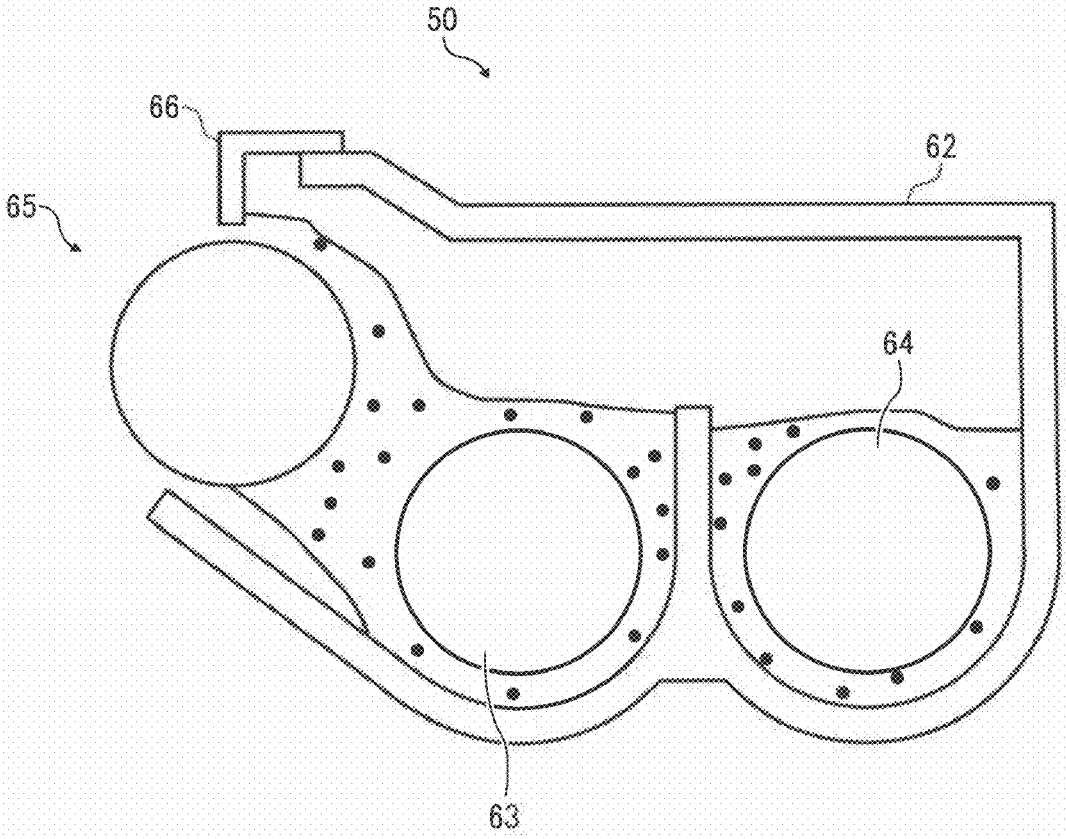
FIG. 22 is a schematic diagram showing the constitution of the developing unit in this developing device.

As shown in FIG. 22, the developing unit 50 includes a casing 62 that constitutes the developer, transport screws 63, 64 that are rotatably supported within the casing 62 and that have spiral shaped fins, and a developing roller 65. The casing 62 is filled with two-component developing agent that is a mixture of toner and carrier. The transport screws 63, 64 transport and circulate the developing agent within the casing 62. The transport screw 63 transports the developing agent from the near side towards the far side in the figure. Some of the developing agent is scooped up by and adheres to a developing roller 65 as a result of magnetic force, and its thickness is leveled by a doctor blade 66. Then when it contacts the photosensitive drum 1 the electrostatic latent image on the photosensitive drum 1 is developed by the toner to form a toner image.

After developing, the developing agent is transported from a discharge aperture 67 (see FIG. 21) formed at an end of the transport screw 64 through the return part of the circulation path 56 to the developing agent agitation unit 51. Toner concentration measuring means, which is not shown on the drawings, is disposed on the most downstream part of the transport screw 64, and based on the signal from the toner concentration measuring means new toner is supplied from the toner cartridge 52.

Replenishment with toner is carried out by rotating a screw, which is not shown on the drawings, within a toner replenishment path 57 using a motor 59 to deliver toner discharged from the toner cartridge 52 to the developing agent agitation unit 51. Replenishment of toner is carried out at a position immediately before the inlet of the developing agent agitation unit 51, which is provided at a position before arriving at the developing unit 50 in the toner transport process.

In the developing agent agitation unit 51, developing agent after developing and replenished toner are agitated and mixed so that developing agent with the appropriate toner concentration and amount of charge is maintained. Developing agent discharged from the developing agent agitation unit 51 passes through a discharge aperture formed in the bottom of the developing agent agitation unit 51 and enters the rotary feeder 53.

Figure 23A:
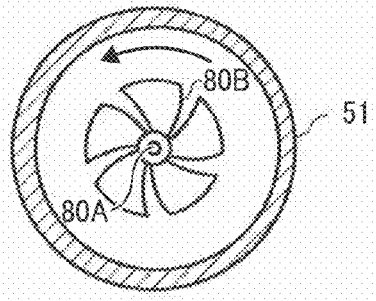
FIGS. 23A and 23B are schematic diagrams showing the constitution of the main parts of this developing device.
Figure 23B:
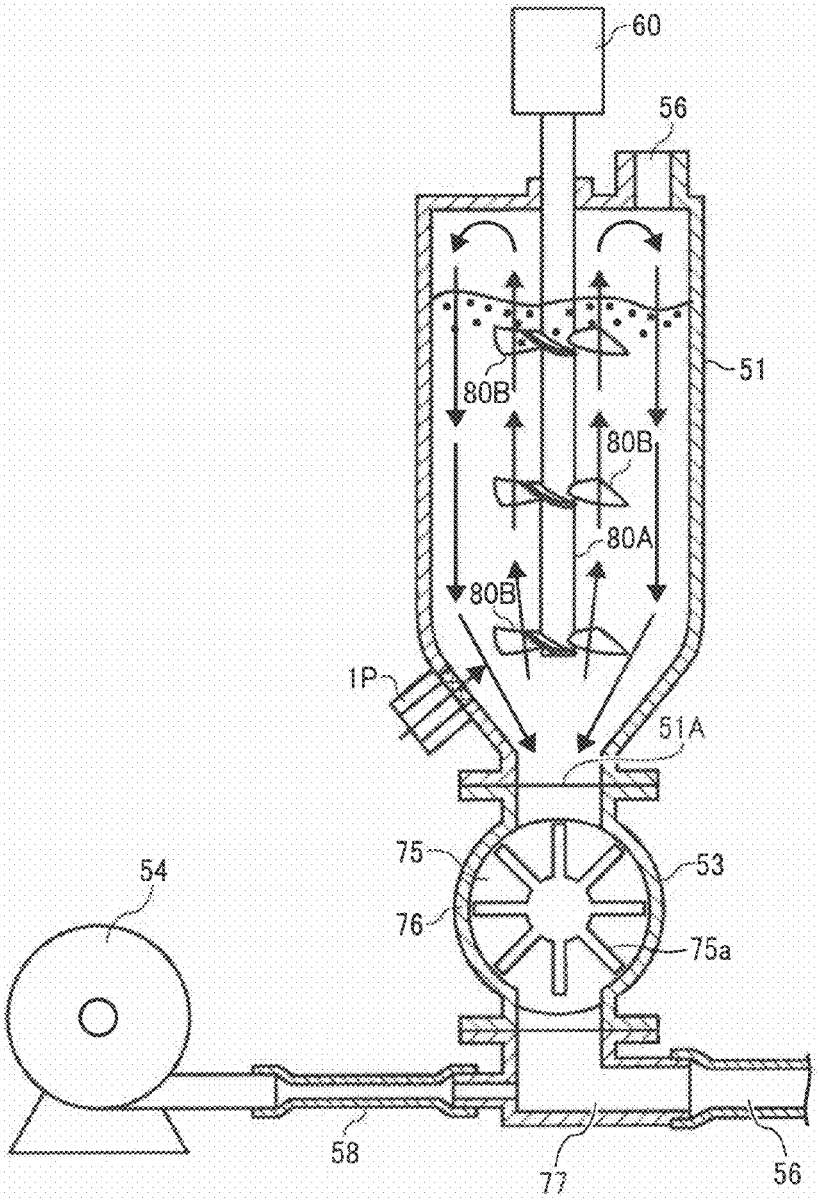

The rotary feeder 53 is a member that is rotationally driven by the motor 61. As shown in FIGS. 23A and 23B which are used to explain the characteristics of the present embodiment, within the rotary feeder 53 there is a rotor 75 with a plurality of fins 75*a* that extend radially, and a stator 76 that covers the rotor 75. The rotary feeder 53 and the circulation path 56 and a pipe path 58 are connected by a joint pipe path 77. Developing agent held within the rotary feeder 53 is discharged downwards in fixed quantities, passes through the circulation path 56, and is supplied again to the developing unit 50 via an inlet 68, as shown in FIG. 21.

The following is an explanation of the characteristics of the developing device provided with the constitution as described above.

In FIGS. 23A and 23B, the developing agent agitation unit 51 has a funnel shape in the form of a downward facing cone shape in vertical section, with a developing agent replenishment portion 56 in the top surface, and a developing agent discharge aperture 51A provided in the bottom.

In the interior space of the developing agent agitation unit 51, a rotating shaft 80A that extends vertically and is located in the center in horizontal cross-section is inserted from the top surface, with a plurality of agitation propellers BOB provided integrally on the rotation shaft 80A along the axial direction. In other words, the agitation propellers BOB are agitation members that agitate by contact with the developing agent, and the orientation of fins and the direction of rotation are set so that an upward rising air flow can be generated within the developing agent agitation unit 51 when the agitation propellers 80B are rotated. Therefore, the agitation propellers BOB are members that by the integral structure with the agitation member constitutes air flow generation means.

In the present embodiment, when the agitation propellers BOB are rotated, the flow of developing agent shown in FIGS. 23A and 23B is generated, and at the top layer of the boundary surface of the developing agent air is incorporated into the developing agent, and this incorporated air forms the rising air flow (compressed air) as a result of the rotation of the propellers as shown in FIG. 23B, and mixing and agitation is caused by the air.

The air flow due to the rotation of the agitation propellers 80B within the developing agent agitation unit 51 is a rising air flow whose direction reduces the downward movement of the developing agent. Therefore, it is possible to carry out mixing and agitation while lifting the developing agent in the direction opposite to the direction for agglomeration due to the weight of the developing agent. In this way, it is possible to improve the agitation efficiency of the developing agent. Moreover, means for introducing air into the developing agent agitation unit 51, for example an air pump or the like, is not necessary, so it is possible to simplify the structure of the agitation unit.

In the constitution described in the present embodiment, external air may be introduced, and in this case, it is desirable that an air inlet be provided in the bottom of the developing agent agitation unit 51 as indicated by reference letters IP in FIG. 23B, from the point of view of the function of generating an upward rising air flow by the agitation propellers 80B.

In the present embodiment, the rising air flow caused by the agitation propellers 80B reverses the falling of the replenished developing agent due to gravity, so there is falling developing agent and rising developing agent within the developing agent agitation unit 51, so good frictional charging is caused by the contact between the developing agent moving in opposite directions.

Next, Modification 8 of the present embodiment is explained.

A characteristic of the present modification is that an inlet is provided that supplies air to the developing agent agitation unit 51.

Figure 24A:
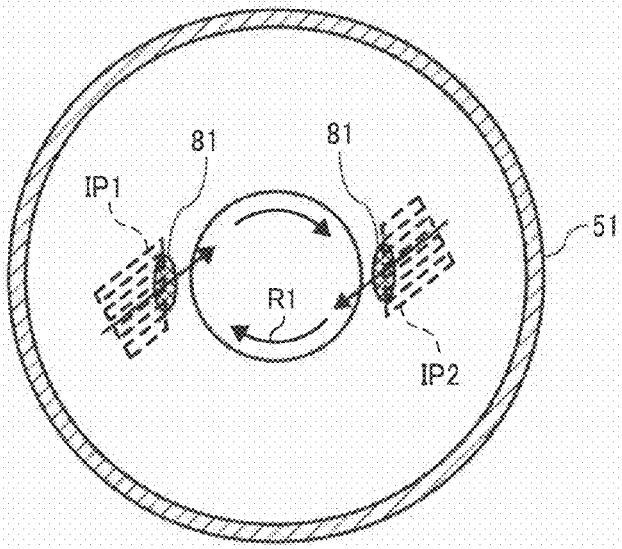
FIGS. 24A and 24B are diagrams showing Modification 8 applied to the main parts of the constitution of the developing device shown in FIGS. 23A and 23B.
Figure 24B:
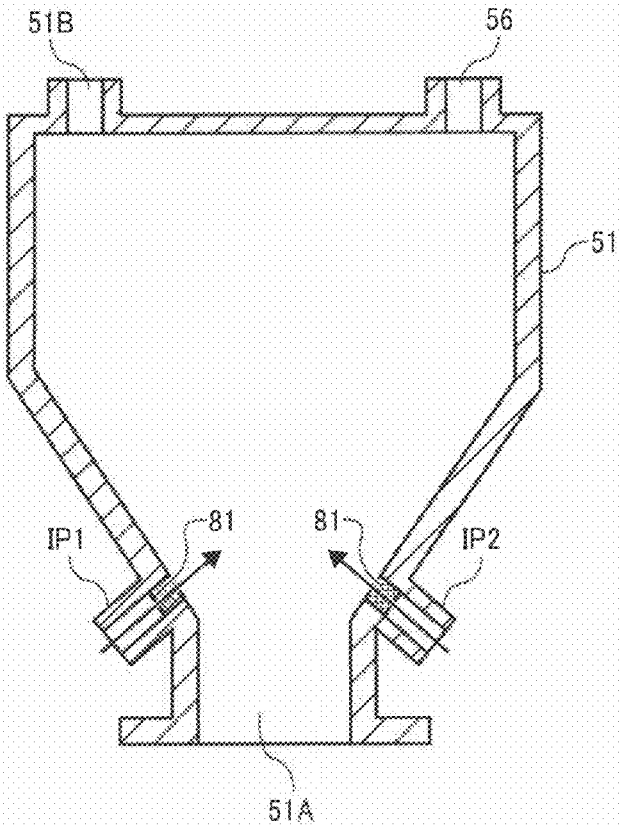

In FIGS. 24A and 24B, air inlets IP1, IP2 that correspond to the air inlets are provided around the circumferential direction in the bottom of the peripheral wall of the developing agent agitation unit 51, and a discharge aperture 51B is provided on the upper wall. An air pump or the like, which is not shown on the drawings, is connected to the air inlets IP1, IP2, so that it is possible to introduce external air.

In the present modification, it is possible to generate a rising air flow within the developing agent agitation unit 51 by introducing compressed air into the bottom of the developing agent agitation unit 51. In this way, it is possible to break down the developing agent which is condensed within the developing agent agitation unit 51 and in which bridging (cross-linking) phenomena occur, by the rising air flow from below. Consequently, it is possible to eliminate blockages and promote the free falling of the development agent. The external air that is introduced into the developing agent agitation unit 51 is discharged to the outside from the discharge aperture 51B, so it is possible to generate a continuous rising air flow within the developing agent agitation unit 51.

In the constitution shown in FIGS. 24A and 24B, if the air pump is stopped, developing agent can leak into the air inlets IP1, IP2 and leak to the outside.

Therefore, in the present Modification 8, a mesh or porous plate 81 is provided on the air inlets IP1, IP2. By providing the mesh or porous plate 81, not only can leakage of developing agent be prevented, but also the introduced external air is finely divided, so it is also possible to finely divide the developing agent, and the powder can be fluidized (a state similar to a fluid). In this way, fluidization of the developing agent is increased compared with the case where the air is not finely divided, so uniform dispersability can be obtained, and it is possible to increase the agitation efficiency and charging efficiency with low stress to the developing agent.

Regarding stoppage of the air pump as described above, there is also an effect of preventing an increase in stress due to repeated contact other than when the developing agent is being agitated, but as stated above, there is a danger of leakage of developing agent from the air inlets IP1, IP2 by back flow. However, by providing the mesh or porous plate 81 as described above, a filter function is provided so back flow of the developing agent can be reduced.

In other words, in the present Modification 8, the constitution of the mesh or porous plate 81 is set so that it has a fineness such that at least the carrier in the developing agent cannot pass through. In this way, by preventing the passage of carrier, back flow of toner adhering to the toner due to the adhesion force between the carrier is also hindered.

Next, Modification 9 of Embodiment 2 is explained.

The present Modification 9 has the characteristic that when a plurality of air inlets is provided, the air supplied into the developing agent agitation unit is made to revolve so that the air flow does not become concentrated in one part.

In FIGS. 24A and 24B, the plurality of air inlets IP1, IP2 provided around the circumference in the bottom of the developing agent agitation unit 51 do not introduce the external air towards the center in a horizontal cross-sectional view of the developing agent agitation unit 51, but are constituted so that the air can be introduced in a direction that deviates a little from the center in the diametral direction and in opposition to each other. In this case, the air inlets IP1, IP2 are oriented to be capable of generating rising air flows within the developing agent agitation unit 51.

In this way, the air introduced into the developing agent agitation unit 51 generates an air flow revolving about the center in the horizontal plane of the developing agent agitation unit 51 (indicated by reference numeral R1 in FIG. 24A). By generating such a revolving air flow within the developing agent agitation unit 51, the air flow can move along the internal walls of the developing agent agitation unit 51. In this way, it is possible to efficiently agitate the whole developing agent agitation unit 51.

The four inventors carried out tests to measure the percentage of weakly charged toner, which can be the cause of contamination, entrainment of toner in air, and other image quality defects, for the following cases: the case where a single air inlet is provided (the constitution shown in FIGS. 23A and 23B), the case where a plurality of air inlets is provided (the constitution shown in FIGS. 24A and 24B), the case where a plurality of air inlets is provided and the air inlets direct the air towards the center in the planar cross-section of the developing agent agitation unit, and the case where a plurality of air inlets is provided so that a revolving air flow is generated in the developing agent agitation unit. The results are shown in FIG. 25.

Figure 25:
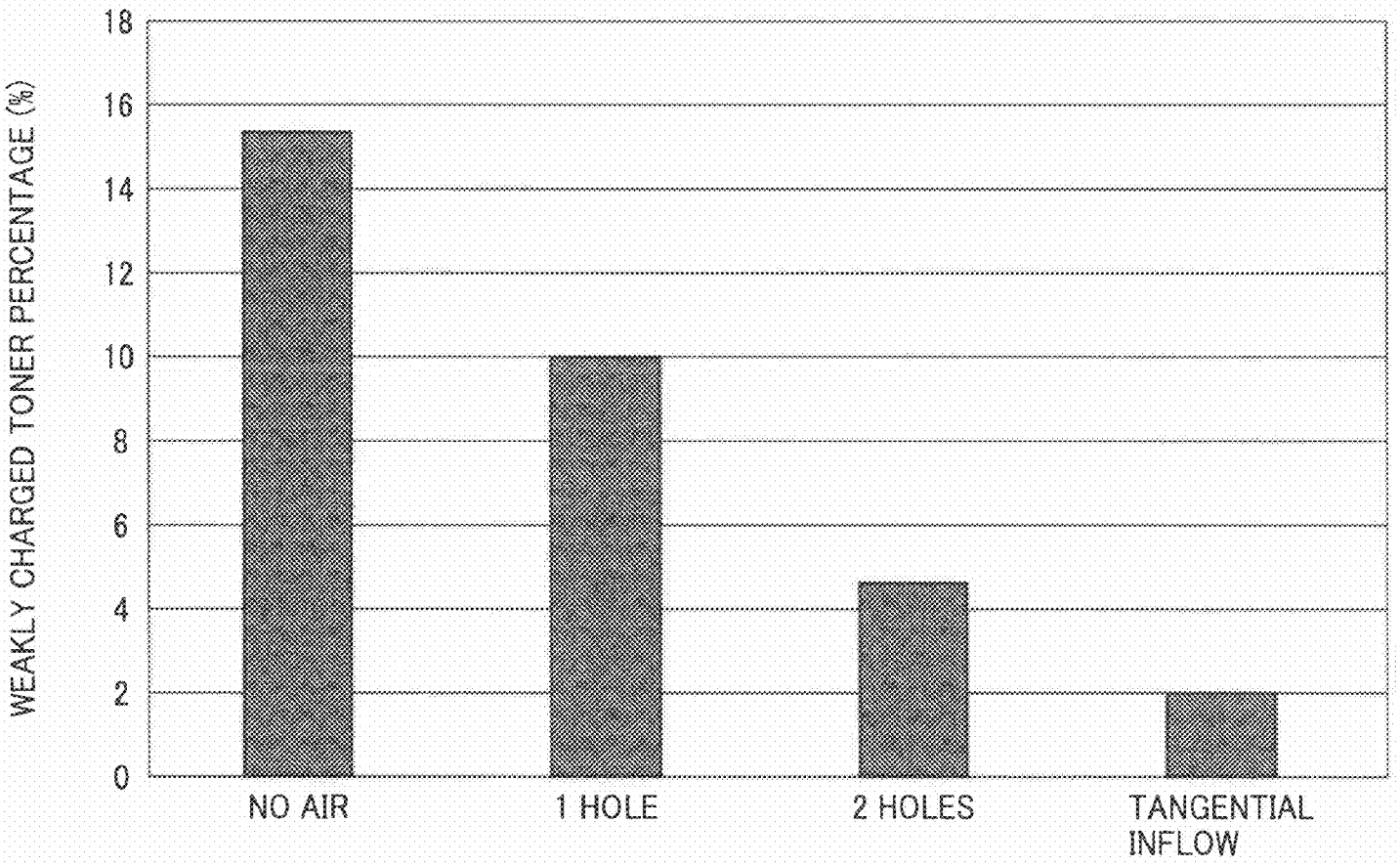
FIG. 25 is a graph showing the relationship between the percentage of weakly charged toner (weakly charger toner percentage) and the method of introducing air in the constitution shown in FIGS. 24A and 24B.

In FIG. 25, "no air" indicates agitation using the agitation member only, "1 hole" and "2 holes" indicates the constitutions shown in FIGS. 23A and 23B and FIG. 24A, and "tangential inflow" indicates the generation of a revolving current. Weakly charged is defined as −1 fC/10 μm or less.

From the results shown in FIG. 25, the percentage of weakly charged is greatly affected by the air inflow format, in particular it can be seen that the charging efficiency is highest for the case where a revolving current is generated.

Figure 26:
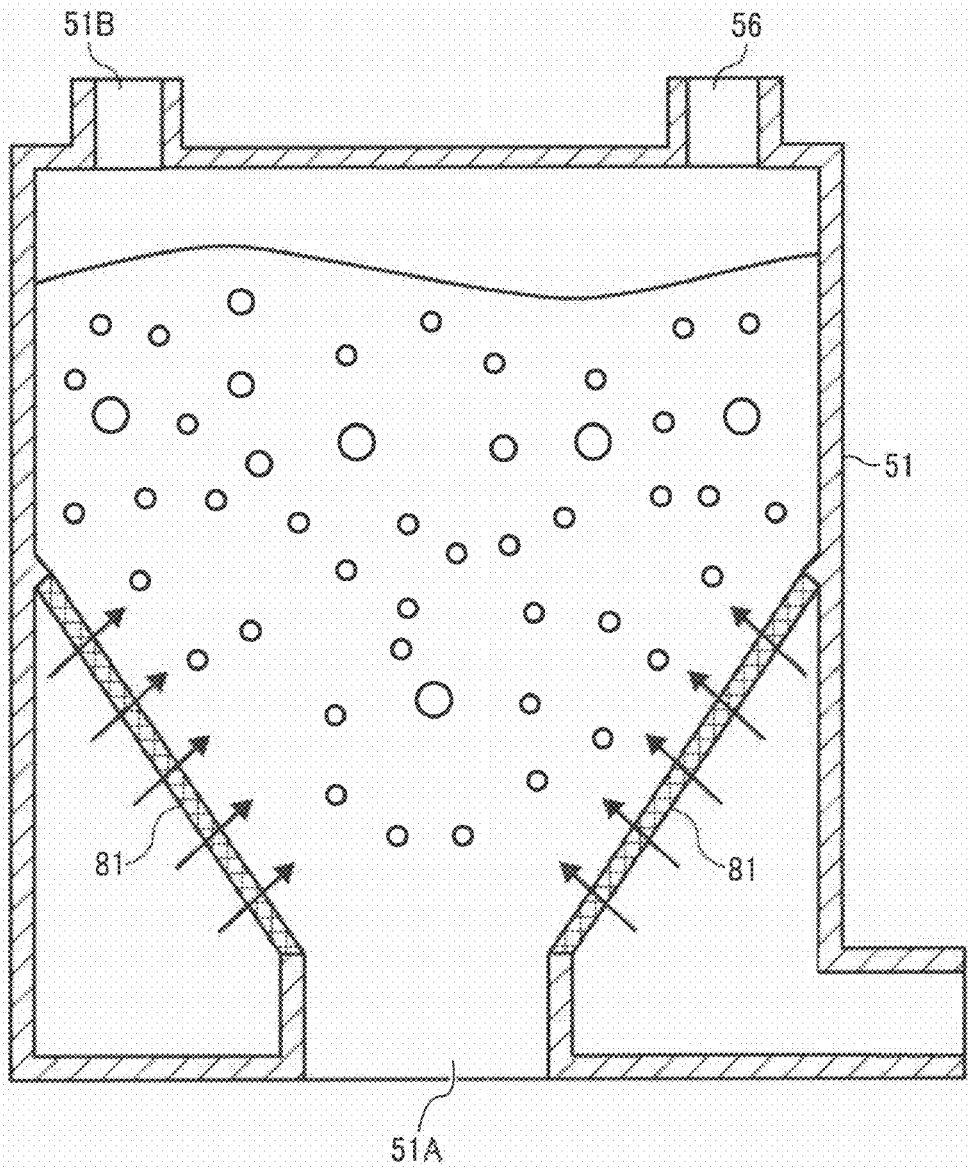
FIG. 26 is a diagram showing another Modification 9 of the constitution of the main parts shown in FIGS. 24A and 24B.

The structure for introducing air is not limited to constitutions with a single or a plurality of holes. As shown in FIG. 26, it is also possible to provide apertures around the complete circumference in the vertical direction on the sloping walls of the developing agent agitation unit 51, and cover the apertures with a mesh or porous plate 81.

In this constitution, as shown by arrows in FIG. 26, small bubbles of air flow into the developing agent from the sloping surfaces, so it is possible to promote fluidization, as well as carry out uniform agitation in a low stress environment by increasing the dispersability of the developing agent by introducing the air into the developing agent over a wide area.

In the present Modification 9, the agitation efficiency of the developing agent within the developing agent agitation unit 51 can be improved when introducing the air, depending on the flow rate. In other words, in order to improve the fluidization of the developing agent and increase the dispersability, a high flow rate is necessary. However, if the flow rate is too high the amount of friction within the developing agent will increase, which can cause degradation. Therefore, in the present Modification 9, sensors to measure the concentration of toner and the humidity, which affect the fluidization of the developing agent, are provided, and it is possible to adjust the flow rate of the air introduced in accordance with the measurement results of these sensors.

On the other hand, the air introduced into the developing agent agitation unit 51 can be set to a humidity lower than the humidity within the developing device. In this way, the dispersability of the developing agent is increased by the air, and a low humidity is maintained within the developing device, so it is possible to increase the ease of charging the toner.

Next, yet another Modification 10 of Embodiment 2 is explained.

In the present Modification 10, not only is the dispersability of the developing agent and the agitation efficiency improved by the air flow within the developing agent agitation unit 51, but also the generation of areas within the developing agent agitation unit 51 where agitation is not possible is prevented.

Figure 27A:
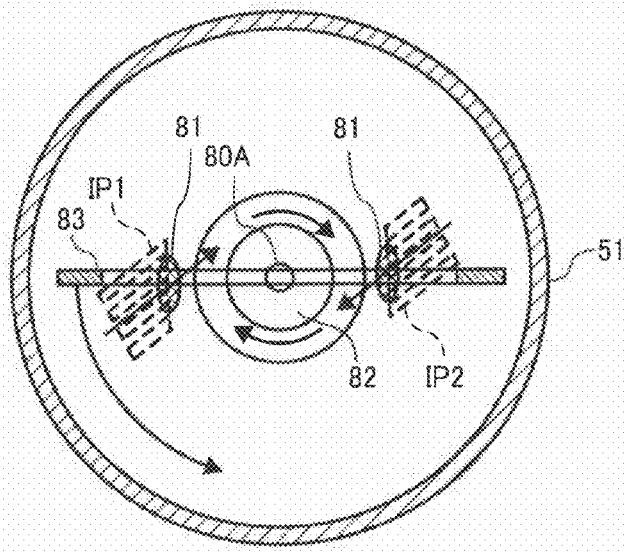
FIGS. 27A and 27B are diagrams showing the constitution of another Modification 10 of the developing device.
Figure 27B:
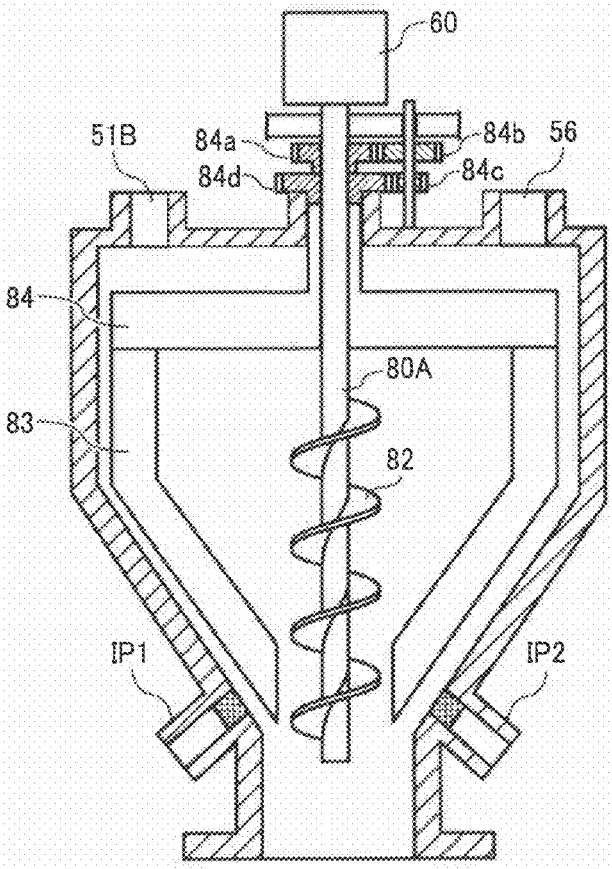

FIGS. 27A and 27B are diagrams showing the constitution for this purpose, and these figures apply to the developing agent agitation unit 51 shown in FIGS. 24A and 24B. In FIGS. 27A and 27B, the air inlets IP1, IP2 are provided on the bottom of the peripheral walls of the developing agent agitation unit 51 so that the compressed air supplied into the developing agent agitation unit 51 can generate a revolving rising air flow, as explained using FIGS. 24A and 24B. An agitation member that includes a first agitation portion 82 and a second agitation portion 83 disposed in an inside and outside relationship on a rotating shaft 80A that is suspended vertically in the interior of the developing agent agitation unit 51 with the axis of rotation in the center in the horizontal cross-section is provided within the developing agent agitation unit 51.

The first agitation portion 82 is constituted as a screw auger set with the reed direction in a direction to raise the developing agent. The second agitation portion 83 is positioned to the outside of the first agitation portion 82, and is constituted as an agitation paddle that is capable of rotating about the rotation axis of the screw auger as center.

The agitation paddle used in the second agitation portion 83 is provided in a position sandwiching the center of the rotating shaft of the screw auger and having its longitudinal direction in the vertical direction, and is fixed at its base end to a flange 84 that is integral with the rotating shaft of the screw auger. Therefore, the first agitation portion 82 can move the developing agent in the opposite direction to the down flow direction of the developing agent, and the second agitation portion 83 rotates in a direction that crosses the flow down direction of the developing agent, and is capable of reducing the flow down of the developing agent.

On the other hand, the gap formed between the inner end of the second agitation portion 83 in opposition to the outer peripheral surface of the first agitation portion 82, which is the screw auger, is made as small as possible, and a mesh or porous plate 81A is provided as the gap partially in the diametral direction of the inner end portion.

In this way, the area in which the developing agent leaks through and falls down as it is between the first and second agitation portions is made as small as possible. Also, the outer peripheral surface of the second agitation portion 83 that is located to the outside is provided as close as possible to the inner surface of the developing agent agitation unit 51. This prevents the reduction of the agitation area by the second agitation portion 83 caused when the developing agent raised by the first agitation portion 82 is outside the area of the screw auger.

The second agitation portion 83 and the first agitation portion 82 are rotationally driven by a motor 60. The first agitation portion 82, which is the screw auger, is directly connected to the motor 60, and the second agitation portion 83, which is the paddle, is rotated via a speed reducing gear train 84*a* through 84*d*.

In the developing agent agitation unit 51, gravity is used for transport from the replenishment aperture 56 to the discharge aperture 51A. There is always developing agent in the developing agent agitation unit 51 as a buffer, so unmixed developing agent is not discharged as it is.

As described above, frictional charging is caused by contact between the developing agent that is raised by the screw auger and the developing agent that is falling down. However, when air is not used, as described above, there is a small gap between the agitation paddle and the inner surface of the developing agent agitation unit. Therefore, a very high stress is applied to the developing agent passing through the gap.

Therefore, in Modification 10, by generating a revolving air flow within the developing agent agitation unit, agglomeration of developing agent within the gap is prevented and the dispersability of the developing agent is increased, as well as reducing the increase in the drive load on the agitation member. In this way, it is possible to improve the charging capacity by increasing the agitatability and ensuring efficient frictional contact between the carrier and the toner.

Figure 28:
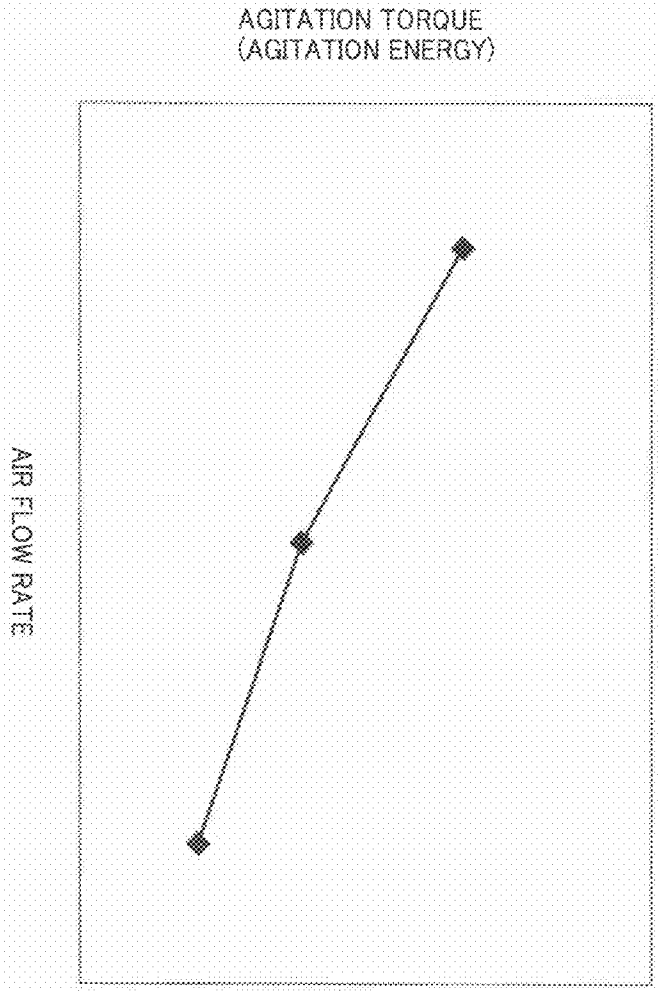
FIG. 28 is a graph showing the change in the air flow rate and the agitation torque in the Modification 10 shown in FIGS. 27A and 27B.

The inventors carried out tests on the variation in torque on the agitation member for the constitution shown in FIGS. 27A and 27B. The results obtained are shown in FIG. 28. As can be seen from the results shown in FIG. 28, as the air flow rate is increased, the agitation torque (agitation energy) on the motor 60 is reduced, so it is possible to reduce the stress on the developing agent. Also, when it is necessary to suddenly increase the amount of charge on the toner, in other words when there is a big difference between the current amount of charge on the toner and the required amount of charge and it is necessary to quickly achieve the required amount of charge, it is necessary to increase the rotational speed of the agitation member. However, this method increases the stress on the developing agent.

Therefore, in the present Modification 10, it is possible to quickly increase the dispersability of the developing agent by adjusting the air flow rate, so it is possible to prevent the increase in stress to the developing agent.

As described above, the following are the characteristics of the present Embodiment 2 and its Modifications 8 through 10.

(1) The developing device includes the developing unit which carries out the process to make a visible image on the electrostatic latent image formed on the latent image carrier using developing agent that includes toner and carrier, and a circulation unit that feeds developing agent that has been recovered from the developing unit to the developing agent supply unit of the developing unit. The circulation unit includes an agitation unit located before the developing unit and that houses a part of the developing agent. The agitation unit includes an agitation member that agitates and mixes the recovered developing agent and replenished toner, and air flow generation means that is capable of generating an air flow in the direction that reduces the amount that the developing agent falls down in a part or in the outside of the agitation unit.

(2) The air flow generation means is an integral structure with the agitation member.

(3) The agitation unit includes a developing agent replenishment aperture in the top portion, constituted so that the developing agent introduced into the developing agent replenishment aperture falls down under gravity.

(4) An inlet for the air that is supplied by the air flow generation means is disposed in the bottom portion of the agitation unit.

(5) A mesh or porous plate member or another alternative member with a fineness such that at least the carrier cannot pass through it is provided at the position where the air supplied by the air flow generation means is introduced into the agitation unit.

(6) A plurality of inlets for the air supplied by the air flow generation means is provided.

(7) The air inlets are provided in a position capable of generating a revolving current.

(8) It is possible to vary the flow rate of the air introduced into the agitation unit.

(9) The humidity of the air introduced into the agitation unit is set lower than the humidity within the agitation unit.

(10) The agitation member is rotatably provided in the center of the agitation unit, and includes a first agitation member that agitates and mixes the developing agent dispersed by the air supplied within the agitation unit, and a second agitation member that is supported on the same axis as the first agitation member and is located to the outside of the first agitation member.

(11) The agitation member is capable of rotating in the opposite direction to the direction of revolution of the developing agent being agitated and mixed within the agitation unit.

(12) The air flow generation means is capable of supplying compressed air within the developing agent agitation unit.

Also, the following are the effects of Embodiment 2 and its Modifications 8 through 10, as described above.

(1) A constitution in which air is supplied in a direction to reduce the down fall of the developing agent is provided within the agitation unit, and compressed air is supplied within the developing agent agitation unit, so the toner and carrier are dispersed by the jet of air. In particular, unlike the situation where the developing agent is agitated by the agitation member only, adhesion and agglomeration of the developing agent is eliminated by the developing agent itself being entrained in the air and floating, so the mechanical stress to the developing agent is reduced, so it is possible to prevent degradation of the developing agent. In this way it is possible to prevent the occurrence of faulty images caused by degradation of the charging capacity or abnormal toner concentration.

(2) The air flow generation means and the agitation member have an integral structure, so the agitation member can perform a different function from its original function, and it is possible to increase the agitation efficiency of the developing agent with a simple constitution.

(3) During the process of the developing agent introduced from above falling under gravity within the agitation unit it is possible to blow up air supplied from below, so the relative velocity of the developing agent itself falling under gravity and the air being blown up in the opposite direction is increased, and further the upward flotation of the developing agent is induced so the dispersability is increased, so it is possible to increase the agitation efficiency of the developing agent.

(4) By providing a mesh or porous plate or the like through which at least the carrier cannot pass on the air inlets, it is possible to fluidize the developing agent, and the developing agent can be mixed and agitated while in a fluidized liquid-like state. Moreover, by fluidizing the developing agent itself it is possible to reduce the occurrence of stress due to agglomeration of the developing agent and the like. Further, as a result of the condition that the carrier cannot pass, it is possible to prevent back flow of developing agent from the air flow inlet to the air pump.

(5) By providing a plurality of air inlets, it is possible to increase the dispersability of the toner and the carrier and increase the frictional charging by increasing the probability of contact between the two.

(6) The air supplied into the developing agent agitation unit can rise while revolving, so it is possible to make the whole container the agitation area. In this way, it is possible to increase the dispersability of the carrier and the toner within the developing agent, and to prevent adhesion of the developing agent to the internal surfaces of the container.

(7) By changing the flow rate of the air, it is possible to adjust the air flow speed within the container, so it is possible to improve the charging capacity by obtaining agitatability corresponding to the amount of replenished toner.

(8) By introducing air that is drier than within the developing device, it is possible to improve the charging capacity by reducing the moisture in the developing agent.

(9) It is possible to increase the charging capacity of the developing agent by the functions of dispersing the developing agent with the introduced air and dispersing the developing agent by agitation.

(10) It is possible to agitate the developing agent in a direction that is opposite to the air introduction direction, so it is possible to improve the charging capacity by increasing the probability of contact of the developing agent.

Various modifications will become possible for those skilled in the art after receiving the teachings of the present disclosure without departing from the scope thereof.

What is claimed is:

1. A developing device using a two-component developing agent comprising toner and carrier, the developing device comprising:

a developing unit;

a developing agent agitation unit provided separate from the developing unit;

an ion generating device, wherein ions generated by the ion generating device enter an air flow to form an ionized air flow that directs the ions into contact with the developing agent;

a developing agent circulation path for circulating the developing agent between the developing unit and the developing agent agitation unit; and an ionized air flow inlet provided on the developing agent circulation path, for introducing the ionized air flow to the developing agent, in order to adjust the amount of charge of the toner and carrier in the developing agent, wherein the ionized air flow inlet is provided on a discharge path from the developing unit to the developing agent agitation unit, on the developing agent circulation path.

2. The developing device as claimed in claim 1, wherein the ion generating device is provided above the discharge path with the ionized air flow inlet disposed therebetween, and the ion generating device comprises a case, and a wire member disposed within the case and applied with a bias voltage between the case and the wire member, such that ions generated by electrical discharge due to the application of the bias voltage are transported by an air flow fed into the case to form the ionized air flow, and the ionized air flow is introduced into the discharge path from the ionized air flow inlet.

3. The developing device as claimed in claim 1, wherein the ionized air flow inlet is provided on a supply path from the developing agent agitation unit to the developing unit, on the developing agent circulation path.

4. The developing device as claimed in claim 1, wherein the ionized air flow inlet is provided in the developing agent agitation unit.

5. The developing device as claimed in claim 1, wherein the operation of the ion generating device can be arbitrarily turned on or off, and the ion balance of positive and negative ions can be arbitrarily controlled.

6. The developing device as claimed in claim 1, wherein a mesh or porous plate or means having the same function as the mesh or porous plate through which at least the carrier cannot pass is disposed on the ionized air flow inlet.

7. The developing device as claimed in claim 1, wherein the ionized air flow is introduced during the circulation of the developing agent from a direction in opposition to the circulation direction of the developing agent.

8. The developing device as claimed in claim 1, wherein a toner replenishment aperture is provided on the discharge path from the developing unit to the developing agent agitation unit and on the upstream side in the direction of transport of the toner with respect to the ionized air flow inlet.

9. The developing device as claimed in claim 1, wherein the rotational speed of an agitation member of the developing agent agitation unit can be arbitrarily controlled.

10. The developing device as claimed in claim 1, wherein a means for circulating the developing agent is air transport using the ionized air flow.

11. The developing device as claimed in claim 1, wherein adjustment of the amount of charge of the toner and carrier is performed by reducing the amount of charge thereof.

12. A method of developing a latent image with a two-component developing agent comprising toner and carrier by using a developing device which comprises a developing unit; a developing agent agitation unit provided separate from the developing unit; a developing agent circulation path for circulating the developing agent between the developing unit and the developing agent agitation unit; and an ion generating device that generates an ionized air flow, the method comprising:

directing the ions generated by the ion generating device into an air flow to form an ionized air flow configured to contact the developing agent; and introducing the ionized air flow through an ionized air flow inlet provided on the developing agent circulation path to adjust the amount of charge of the toner and carrier in the developing agent, wherein the ionized air flow inlet is provided on a discharge path from the developing unit to the developing agent agitation unit, on the developing agent circulation path.

13. The method as claimed in claim 12, wherein the ion generating device is provided above the discharge path with the ionized air flow inlet disposed therebetween, and the ion generating device comprises a case, and a wire member disposed within the case and applied with a bias voltage between the case and the wire member, such that ions generated by electrical discharge due to the application of the bias voltage are transported by an air flow fed into the case to form the ionized air flow, and the ionized air flow is introduced into the discharge path from the ionized air flow inlet.

14. The method as claimed in claim 12, wherein the ionized air flow inlet is provided on a supply path from the developing agent agitation unit to the developing unit, on the developing agent circulation path.

15. The method as claimed in claim 12, wherein the ionized air flow inlet is provided in the developing agent agitation unit.

16. The method as claimed in claim 12, wherein a mesh or porous plate or means having the same function as the mesh or porous plate through which at least the carrier cannot pass is disposed on the ionized air flow inlet.

17. A developing device using a two-component developing agent comprising toner and carrier, the developing device comprising:

a developing unit;

a developing agent agitation unit provided separate from the developing unit;

an ion generating device, wherein ions generated by the ion generating device enter an air flow to form an ionized air flow that directs the ions into contact with the developing agent;

a developing agent circulation path for circulating the developing agent between the developing unit and the developing agent agitation unit; and an ionized air flow inlet provided on the developing agent circulation path, for introducing the ionized air flow to the developing agent, in order to adjust the amount of charge of the toner and carrier in the developing agent, wherein adjustment of the amount of charge of the toner and carrier is performed by reducing the amount of charge thereof.

18. A method of developing a latent image with a two-component developing agent comprising toner and carrier by using a developing device which comprises a developing unit; a developing agent agitation unit provided separate from the developing unit; a developing agent circulation path for circulating the developing agent between the developing unit and the developing agent agitation unit; and an ion generating device that generates an ionized air flow, the method comprising:

directing the ions generated by the ion generating device into an air flow to form an ionized air flow configured to contact the developing agent; and introducing the ionized air flow through an ionized air flow inlet provided on the developing agent circulation path to adjust the amount of charge of the toner and carrier in the developing agent, wherein a mesh or porous plate or means having the same function as the mesh or porous plate through which at least the carrier cannot pass is disposed on the ionized air flow inlet.

* * * * *